US009971310B2

(12) United States Patent
Sakai et al.

(10) Patent No.: US 9,971,310 B2
(45) Date of Patent: May 15, 2018

(54) MOVEMENT AND ELECTRONIC TIMEPIECE

(71) Applicant: SEIKO INSTRUMENTS INC., Chiba-shi, Chiba (JP)

(72) Inventors: Satoshi Sakai, Chiba (JP); Katsuya Mugishima, Chiba (JP); Tomohiro Ihashi, Chiba (JP); Kenji Ogasawara, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days. days.

(21) Appl. No.: 15/237,868

(22) Filed: Aug. 16, 2016

(65) Prior Publication Data

US 2017/0052511 A1 Feb. 23, 2017

(30) Foreign Application Priority Data

Aug. 21, 2015 (JP) ..... 2015-163992
May 27, 2016 (JP) ..... 2016-106237

(51) Int. Cl.
*G04C 3/14* (2006.01)
*G04B 27/00* (2006.01)

(52) U.S. Cl.
CPC ..... *G04C 3/146* (2013.01); *G04B 27/001* (2013.01); *G04C 3/14* (2013.01)

(58) Field of Classification Search
CPC . G04C 3/14; G04C 3/146; G04C 9/00; G04B 27/00; G04B 27/001; G04G 5/00; G04G 5/002
See application file for complete search history.

(56) References Cited

U.S. PATENT DOCUMENTS 7,154,818 B2 * 12/2006 Liu ..... G04C 3/146 368/187
7,505,370 B2 * 3/2009 Rydgren ..... G04C 17/0091 368/10

(Continued)

OTHER PUBLICATIONS

Abstract, Publication No. JP 2010-217015, Publication date Sep. 30, 2010.

*Primary Examiner* — Vit W Miska
(74) *Attorney, Agent, or Firm* — Bruce L. Adams

(57) ABSTRACT

A timepiece movement includes a center wheel & pinion that drives a minute hand, a second wheel & pinion arranged coaxially with a center axle of the center wheel & pinion, a first light emitting element arranged on one side in an axial direction of the center axle with respect to the center wheel & pinion and the second wheel & pinion, and a first light receiving element arranged on the other side in the axial direction of the center axle across the second wheel & pinion, and that detects light emitted from the first light emitting element. The center wheel & pinion has a first center wheel transmittable portion through which the light emitted from the first light emitting element is transmittable, and a second center wheel transmittable portion which is disposed on a rotation trajectory of the first center wheel transmittable portion and through which the light emitted from the first light emitting element is transmittable. The second wheel & pinion has a first second wheel transmittable portion which is disposed on the rotation trajectory of the first center wheel transmittable portion and the second center wheel transmittable portion when viewed in the axial direction of the center axle and through which the light emitted from the first light emitting element is transmittable.

11 Claims, 13 Drawing Sheets

(56) References Cited

U.S. PATENT DOCUMENTS

| | | | | |
|---|---|---|---|---|
| 8,208,348 | B2 * | 6/2012 | Kojima | G04C 3/14 368/185 |
| 2004/0120220 | A1 * | 6/2004 | Ogasawara | G04C 3/14 368/80 |
| 2006/0114750 | A1 * | 6/2006 | Iida | G04C 3/146 368/67 |
| 2009/0086580 | A1 * | 4/2009 | Aoki | G04C 3/14 368/10 |
| 2009/0086581 | A1 * | 4/2009 | Suizu | G04C 3/14 368/10 |

* cited by examiner

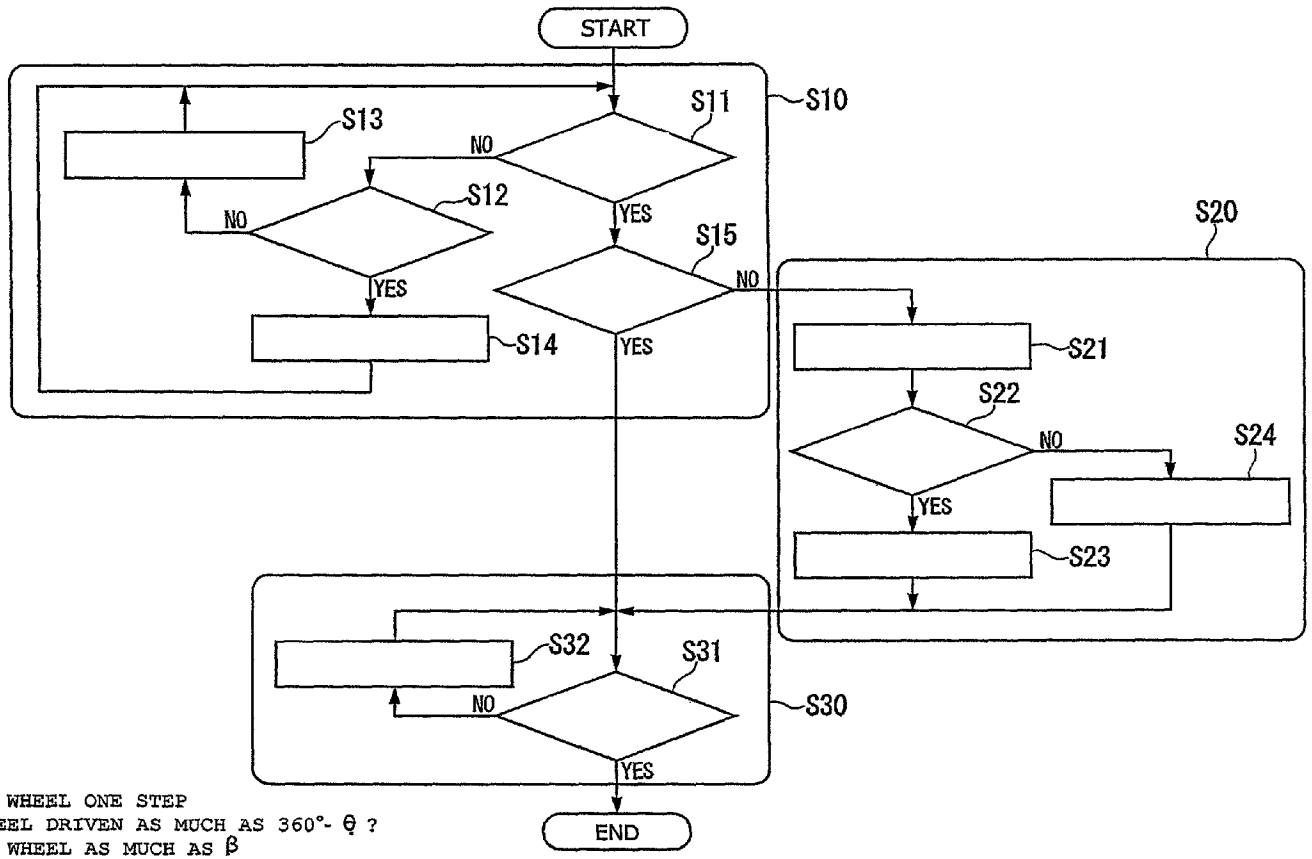

FIG.13

S13 DRIVE CENTER WHEEL ONE STEP
S12 IS CENTER WHEEL DRIVEN AS MUCH AS 360°- θ ?
S14 DRIVE SECOND WHEEL AS MUCH AS β
S11 DOES FIRST LIGHT RECEIVING ELEMENT RECEIVE LIGHT?
S15 IS CENTER WHEEL DRIVEN AS MUCH AS θ OR LARGER?
S21 DRIVE CENTER WHEEL AS MUCH AS θ
S22 DOES FIRST LIGHT RECEIVING ELEMENT RECEIVE LIGHT?
S23 DRIVE CENTER WHEEL AS MUCH AS 360°- θ
S24 DRIVE CENTER WHEEL AS MUCH AS θ
S32 DRIVE SECOND WHEEL ONE STEP
S31 IS DESIRED PATTERN DETECTED?

18 LIGHT EMITTING CONTROL UNIT
61 FIRST LIGHT EMITTING ELEMENT
62 SECOND LIGHT EMITTING ELEMENT
63 THIRD LIGHT EMITTING ELEMENT
21 FIRST STEPPING MOTOR
22 SECOND STEPPING MOTOR
64 FIRST LIGHT RECEIVING ELEMENT
65 SECOND LIGHT RECEIVING ELEMENT
19 DETECTION CONTROL UNIT
17 ROTATION CONTROL UNIT
66 THIRD LIGHT RECEIVING ELEMENT
23 THIRD STEPPING MOTOR

18 LIGHT EMITTING CONTROL UNIT
61 FIRST LIGHT EMITTING ELEMENT
62 SECOND LIGHT EMITTING ELEMENT
63 THIRD LIGHT EMITTING ELEMENT
21 FIRST STEPPING MOTOR
22 SECOND STEPPING MOTOR
64 FIRST LIGHT RECEIVING ELEMENT
65 SECOND LIGHT RECEIVING ELEMENT
19 DETECTION CONTROL UNIT
17 ROTATION CONTROL UNIT
66 THIRD LIGHT RECEIVING ELEMENT
23 THIRD STEPPING MOTOR

MOVEMENT AND ELECTRONIC TIMEPIECE

BACKGROUND OF THE INVENTION

Field of the Invention

The present invention relates to a movement and an electronic timepiece.

Background Art

In the related art, an electronic timepiece such as a radio timepiece provided with an automatic correction function of a hand position is known.

For example, Japanese Patent No. 5267244 discloses an electronic timepiece. In the electronic timepiece, a first train wheel includes one or more first train wheel detection gears having a detection hole through which detection light output from a light emitting element is transmittable. A second train wheel includes a detection light transmitting gear arranged coaxially with anyone of the first train wheel detection gears in the first train wheel. In the detection light transmitting gear, a long hole through which the detection light is transmittable and a light-blocking portion for blocking the detection light are formed at a position overlapping a rotation trajectory of the detection hole of the first train wheel detection gear.

According to the electronic timepiece disclosed in Japanese Patent No. 5267244, it is possible to coaxially arrange multiple indicating hands driven by different motors and train wheels. Even if the electronic timepiece does not include a hand position detection mechanism of the other side indicating hand, the electronic timepiece can reliably and quickly detect a hand position of one side indicating hand.

According to the electronic timepiece in the related art, in order to determine whether or not the long hole is arranged at a position corresponding to an optical sensor, the first train wheel detection gear needs to be rotated once.

SUMMARY OF THE INVENTION

Incidentally, for example, an electronic timepiece including a solar panel has a limited power amount stored in a secondary battery. Accordingly, in order to further lengthen an operating time period of the electronic timepiece, an effective way is to further reduce power consumption. Therefore, the above-described electronic timepiece in the related art needs to minimize a rotation amount of a first train wheel detection gear, and to reduce the power consumption when a hand position is detected.

Therefore, the present invention aims to provide a movement and an electronic timepiece which can reduce power consumption when a hand position is detected.

According to an aspect of the invention, there is provided a movement including a first gear that is rotated by power of a first drive source so as to drive a first indicating hand, a second gear that is arranged coaxially with a center axle of the first gear, and that is rotated by power of a second drive source so as to drive a second indicating hand, a light emitting element that is arranged on one side in an axial direction of the center axle of the first gear, with respect to the first gear and the second gear, and a first light receiving element that is arranged on the other side in the axial direction across the first gear and the second gear, and that detects light emitted from the light emitting element. The first gear has a first transmittable portion through which the light emitted from the light emitting element is transmittable, and a second transmittable portion which is disposed on a rotation trajectory of the first transmittable portion and through which the light emitted from the light emitting element is transmittable. The second gear has a third transmittable portion which is disposed on the rotation trajectory of the first transmittable portion and the second transmittable portion when viewed in the axial direction, and through which the light emitted from the light emitting element is transmittable.

In the aspect, the first transmittable portion and the second transmittable portion are disposed in the first gear. The third transmittable portion is disposed in the second gear arranged coaxially with the center axle of the first gear. When a rotation position of the first gear is detected in order to detect a position of the first indicating hand, the light emitted from the light emitting element is detected by the first light receiving element after being transmitted through either the first transmittable portion or the second transmittable portion, and the third transmittable portion.

In a case where the third transmittable portion is located at a position other than a position corresponding to a portion between the light emitting element and the first light receiving element (hereinafter, referred to as a "first detection position"), the light emitted from the light emitting element is blocked by the second gear. In this case, even if either the first transmittable portion or the second transmittable portion is located at the first detection position, the first light receiving element cannot detect the light emitted from the light emitting element, and cannot detect a position of the first gear.

In the aspect, the first gear has the first transmittable portion and the second transmittable portion which are disposed on the same rotation trajectory and through which the light emitted from the light emitting element is transmittable. Accordingly, when a central angle formed between the first transmittable portion and the second transmittable portion is set to 0, the first gear is rotated as much as $360°-\theta$. In this manner, either the first transmittable portion or the second transmittable portion passes through the first detection position. Therefore, it is possible to determine whether or not the third transmittable portion is located at the first detection position by rotating the first gear as much as $360°-\theta$. Accordingly, compared to a configuration in which the first gear is rotated as much as 360° as in the related art, it is possible to quickly determine whether or not the third transmittable portion is located at the first detection position. Therefore, it is possible to shorten a time for operating the light emitting element, and thus, it is possible to reduce power consumption when a hand position is detected.

In the aspect, it is preferable that the third transmittable portion is a long hole along a circumferential direction of the second gear, and that a dimension along the circumferential direction of the third transmittable portion is equal to or greater than a dimension along the circumferential direction between end portions of the third transmittable portion in a region other than the third transmittable portion.

In the aspect, the third transmittable portion is the long hole along the circumferential direction of the second gear. Accordingly, it is possible to increase probability that the third transmittable portion may be located at the first detection position. Moreover, the dimension of the third transmittable portion along the circumferential direction of the second gear is equal to or greater than the dimension between the end portions of the third transmittable portion along the circumferential direction of the second gear in the region other than the third transmittable portion. Therefore, in a case where the third transmittable portion is located at a position other than the first detection position, the second gear is rotated as much as an angle equal to or larger than the central angle corresponding to the portion between the end portions of the third transmittable portion which corresponds to the region other than the third transmittable portion and as much as an angle equal to or smaller than the central angle corresponding to the third transmittable portion. In this manner, the third transmittable portion can be moved to the first detection position. Accordingly, the light emitted from the light emitting element is transmitted through either the first transmittable portion or the second transmittable portion, and the third transmittable portion. Accordingly, the light emitted from the light emitting element can be more quickly detected by the first light receiving element. Therefore, it is possible to shorten a time for operating the light emitting element, and thus, it is possible to reduce power consumption when a hand position is detected.

In the aspect, it is preferable that the second gear has a fourth transmittable portion which is disposed on the rotation trajectory of the third transmittable portion, and through which the light emitted from the light emitting element is transmittable.

In the aspect, the light emitted from the light emitting element and transmitted through the first transmittable portion or the second transmittable portion, and the fourth transmittable portion is detected by the first light receiving element. In this manner, for example, even in a case where multiple third transmittable portions are disposed at equal intervals, it is possible to detect the rotation position of the second gear. In this case, while the second gear is rotated, the third transmittable portion and the fourth transmittable portion are caused to pass through the first detection position. A transmission pattern of the light which corresponds to a shape, a position, or the number of the third transmittable portions and the fourth transmittable portions is detected by the first light receiving element. In this manner, the fourth transmittable portion of the second gear is identified in a state where the fourth transmittable portion is distinguished from the third transmittable portion. Therefore, it is possible to detect the rotation position of the second gear.

In the aspect, the movement may further include a second light receiving element that is disposed on the other side in the axial direction across the first gear and the second gear, and a first position detecting gear that is arranged between the light emitting element and the second light receiving element in the axial direction, and that is rotated by the power of the second drive source. It is preferable that the first position detecting gear has a fifth transmittable portion through which the light emitted from the light emitting element is transmittable. It is preferable that the second light receiving element is disposed so that the light emitted from the light emitting element and transmitted through the second transmittable portion can be detected, in a predetermined state where the first gear can transmit the light emitted from the light emitting element to the first light receiving element in the first transmittable portion. It is preferable that when viewed in the axial direction, the fifth transmittable portion is disposed so as to be located at a position corresponding to the fourth transmittable portion, when the fourth transmittable portion is located at a position corresponding to the second transmittable portion of the first gear in the predetermined state.

In the aspect, in the predetermined state where the first gear can transmit the light emitted from the light emitting element to the first light receiving element in the first transmittable portion, the light emitted from the light emitting element can be detected by the second light receiving element after being transmitted through the second transmittable portion of the first gear. Accordingly, after the rotation position of the first gear is completely detected and the first gear is brought into the predetermined state, the light emitted from the light emitting element and transmitted through the second transmittable portion and the fourth transmittable portion is detected by the second light receiving element. In this manner, for example, even in a case where multiple third transmittable portions are disposed at equal intervals, it is possible to detect the rotation position of the second gear. In this case, while the second gear is rotated, the third transmittable portion and the fourth transmittable portion are caused to pass through a position corresponding to a portion between the light emitting element and the second light receiving element (hereinafter, referred to as a "second detection position"). A transmission pattern of the light which corresponds to a shape, a position, or the number of the third transmittable portions and the fourth transmittable portions is detected by the second light receiving element. In this manner, the fourth transmittable portion of the second gear is identified in a state where the fourth transmittable portion is distinguished from the third transmittable portion. Therefore, it is possible to detect the rotation position of the second gear.

In addition, for example, in a case where the second indicating hand is the second hand of multi-Hz drive, depending on the rotation angle of the second gear for one step of the second drive source, it may become necessary to rotate the second drive source several steps in order for the fourth transmittable portion located at the second detection position to completely withdraw from the second detection position.

In the aspect, there is provided the first position detecting gear having the fifth transmittable portion located at a position corresponding to the fourth transmittable portion, when the fourth transmittable portion is located at a position corresponding to the second transmittable portion of the first gear in the predetermined state when viewed in the axial direction. A gear ratio of the second gear with respect to the first position detecting gear is set to be smaller than 1. In this manner, the rotation angle of the first position detecting gear for one step of the second drive source can become larger than the rotation angle of the second gear. In this manner, the fifth transmittable portion located at the second detection position can completely withdraw from the second detection position by rotating the second drive source one step. Accordingly, even in a case where it is necessary to rotate the second drive source several steps in order for the fourth transmittable portion located at the second detection position to completely withdraw from the second detection position, the light emitted from the light emitting element can be blocked in a region other than the fifth transmittable portion of the first position detecting gear. Accordingly, one step of the second drive source enables the second light receiving element to be transferred between a state where the light emitted from the light emitting element can be detected and a state where the light cannot be detected. Therefore, it is possible to reliably detect the rotation position of the second gear in response to the position detection of the second indicating hand.

In the aspect, the movement may further include a second position detecting gear that is arranged between the light emitting element and the first light receiving element in the axial direction, and that is rotated by the power of the first drive source. It is preferable that the second position detecting gear has a sixth transmittable portion through which the light emitted from the light emitting element is transmittable. It is preferable that when viewed in the axial direction, the sixth transmittable portion is disposed so as to be located at a position corresponding to the first transmittable portion, in a state where the first gear can transmit the light emitted from the light emitting element to the first light receiving element in the first transmittable portion. It is preferable that when viewed in the axial direction, the sixth transmittable portion is disposed so as to be located at a position corresponding to the second transmittable portion, in a state where the first gear can transmit the light emitted from the light emitting element to the first light receiving element in the second transmittable portion.

Depending on the rotation angle of the first gear for one step of the first drive source, it may become necessary to rotate the first drive source several steps in order for the first transmittable portion or the second transmittable portion located at the first detection position to completely withdraw from the first detection position.

In the aspect, the sixth transmittable portion belonging to the second position detecting gear is disposed at a position corresponding to the first transmittable portion when viewed in the axial direction, in a state where the first gear can transmit the light emitted from the light emitting element to the first light receiving element in the first transmittable portion. In addition, the sixth transmittable portion is disposed at a position corresponding to the second transmittable portion when viewed in the axial direction, in a state where the first gear can transmit the light emitted from the light emitting element to the first light receiving element in the second transmittable portion. A gear ratio of the first gear with respect to the second position detecting gear is set to be smaller than 1. In this manner, the rotation angle of the second position detecting gear for one step of the first drive source can become larger than the rotation angle of the first gear. In this manner, the sixth transmittable portion located at the first detection position can completely withdraw from the first detection position by rotating the first drive source one step. Accordingly, even in a case where it is necessary to rotate the first drive source several steps in order for the first transmittable portion or the second transmittable portion located at the first detection position to completely withdraw from the first detection position, the light emitted from the light emitting element can be blocked in a region other than the sixth transmittable portion of the second position detecting gear. Accordingly, one step of the first drive source enables the first light receiving element to be transferred between a state where the light emitted from the light emitting element can be detected and a state where the light cannot be detected. Therefore, it is possible to reliably detect the rotation position of the first gear in response to the position detection of the first indicating hand.

In the aspect, the movement may further include a control unit that controls driving of the first drive source and the second drive source, and that detects the light received by the first light receiving element. It is preferable that a central angle formed between the first transmittable portion and the second transmittable portion in the first gear is set to θ. It is preferable that the control unit performs a transmitted state determination step of determining whether or not the first light receiving element receives the light emitted from the light emitting element, a rotation angle determination step of determining whether or not a rotation angle of the first gear is equal to or larger than 360°−θ, in a case where the first light receiving element does not receive the light emitted from the light emitting element in the transmitted state determination step, a first drive step of performing the transmitted state determination step again by driving the first drive source and rotating the first gear, in a case where the control unit determines that the rotation angle of the first gear is not equal to or larger than 360°−θ, in the rotation angle determination step, and a second drive step of performing the transmitted state determination step again by driving the second drive source and rotating the second gear as much as a predetermined angle, in a case where the control unit determines that the rotation angle of the first gear is equal to or larger than 360°−θ, in the rotation angle determination step.

In the aspect, the control unit repeatedly rotates the first gear in the first drive step, and performs the second drive step when the control unit determines that the rotation angle of the first gear is equal to or larger than 360°−θ, in the rotation angle determination step. Accordingly, compared to a configuration in which the first gear is rotated as much as 360° as in the related art, it is possible to quickly determine whether or not the third transmittable portion is located at the first detection position. Therefore, it is possible to shorten a time for operating the light emitting element, and thus, it is possible to reduce power consumption when a hand position is detected.

According to another aspect of the invention, there is provided an electronic timepiece including the movement and a power source that supplies power to the first drive source and the second drive source.

In the aspect, since there is provided the movement, it is possible to provide the electronic timepiece which can reduce power consumption when a hand position is detected.

In the aspect, it is preferable that the electronic timepiece further includes a solar panel that supplies power to the first drive source and the second drive source.

In the aspect, it is possible to reduce power consumption when a hand position is detected. Therefore, the invention is preferably applied to the electronic timepiece including the solar panel.

In the aspect, the first gear has the first transmittable portion and the second transmittable portion which are disposed on the same rotation trajectory, and through which the light emitted from the light emitting element is transmittable. Accordingly, when the central angle between the first transmittable portion and the second transmittable portion is set to θ, the first gear is rotated as much as 360°−θ. In this manner, either the first transmittable portion or the second transmittable portion passes through the first detection position. Therefore, it is possible to determine whether or not the third transmittable portion is located at the first detection position by rotating the first gear as much as 360°−θ. Accordingly, compared to a configuration in which the first gear is rotated as much as 360° as in the related art, it is possible to quickly determine whether or not the third transmittable portion is located at the first detection position. Therefore, it is possible to shorten a time for operating the light emitting element, and thus, it is possible to reduce power consumption when a hand position is detected.

BRIEF DESCRIPTION OF THE DRAWINGS

FIG. 13 is a flowchart illustrating a hand position detection operation according to the first embodiment.

DETAILED DESCRIPTION OF THE INVENTION

Hereinafter, embodiments according to the invention will be described with reference to the drawings.

First Embodiment

First, a first embodiment will be described.

In general, a mechanical body including a drive source of a timepiece is called a "movement". The timepiece in a finished state where the movement is accommodated in a timepiece case by attaching a dial and indicating hands to the movement is referred to as a "complete assembly".

A side having glass of the timepiece case on both sides of a main plate configuring a substrate of the timepiece, that is, a side having a dial is referred to as a "rear side". In addition, a side having a case rear cover of the timepiece case in both sides of the main plate, that is, a side opposite to the dial is referred to as a "front side" of the movement.

Electronic Timepiece

Figure 1:
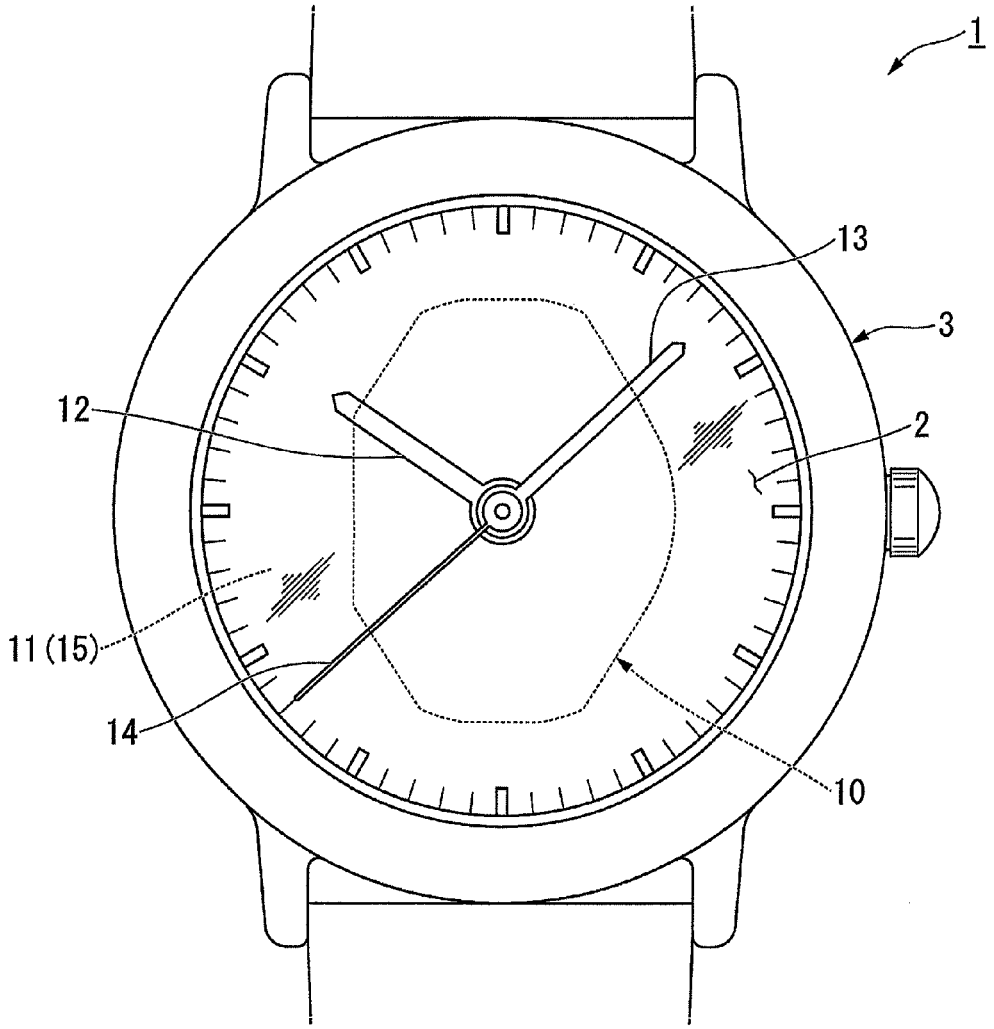
FIG. 1 is an external view illustrating an electronic timepiece according to an embodiment.

FIG. 1 is an external view of an electronic timepiece according to the embodiment.

As illustrated in FIG. 1, an electronic timepiece 1 according to the present embodiment is an analog timepiece of multi-Hz drive (4 Hz drive in the present embodiment) in which a secondhand 14 is driven multiple times per second. In other words, the electronic timepiece 1 relates to an analog timepiece which employs a drive system in which the secondhand is operated one second by receiving a drive pulse from a stepping motor as many as multiple steps. The complete assembly of the electronic timepiece 1 includes a movement 10, a dial 11, and indicating hands 12, 13, and 14 inside a timepiece case 3 having the case rear cover (not illustrated) and glass 2.

The dial 11 is formed integrally with a solar panel 15, and has a scale indicating information relating to at least the hour. The solar panel 15 generates power to be supplied to respective stepping motors 21, 22, and 23 (refer to FIG. 2) via a control unit 16 (refer to FIG. 3) (to be described later). The indicating hands 12, 13, and 14 include the hour hand 12 indicating the hour, the minute hand 13 (first indicating hand) indicating the minute, and the second hand 14 (second indicating hand) indicating the second. The dial 11, the hour hand 12, the minute hand 13, and the second hand 14 are arranged so as to be visible through the glass 2.

Movement

Figure 2:
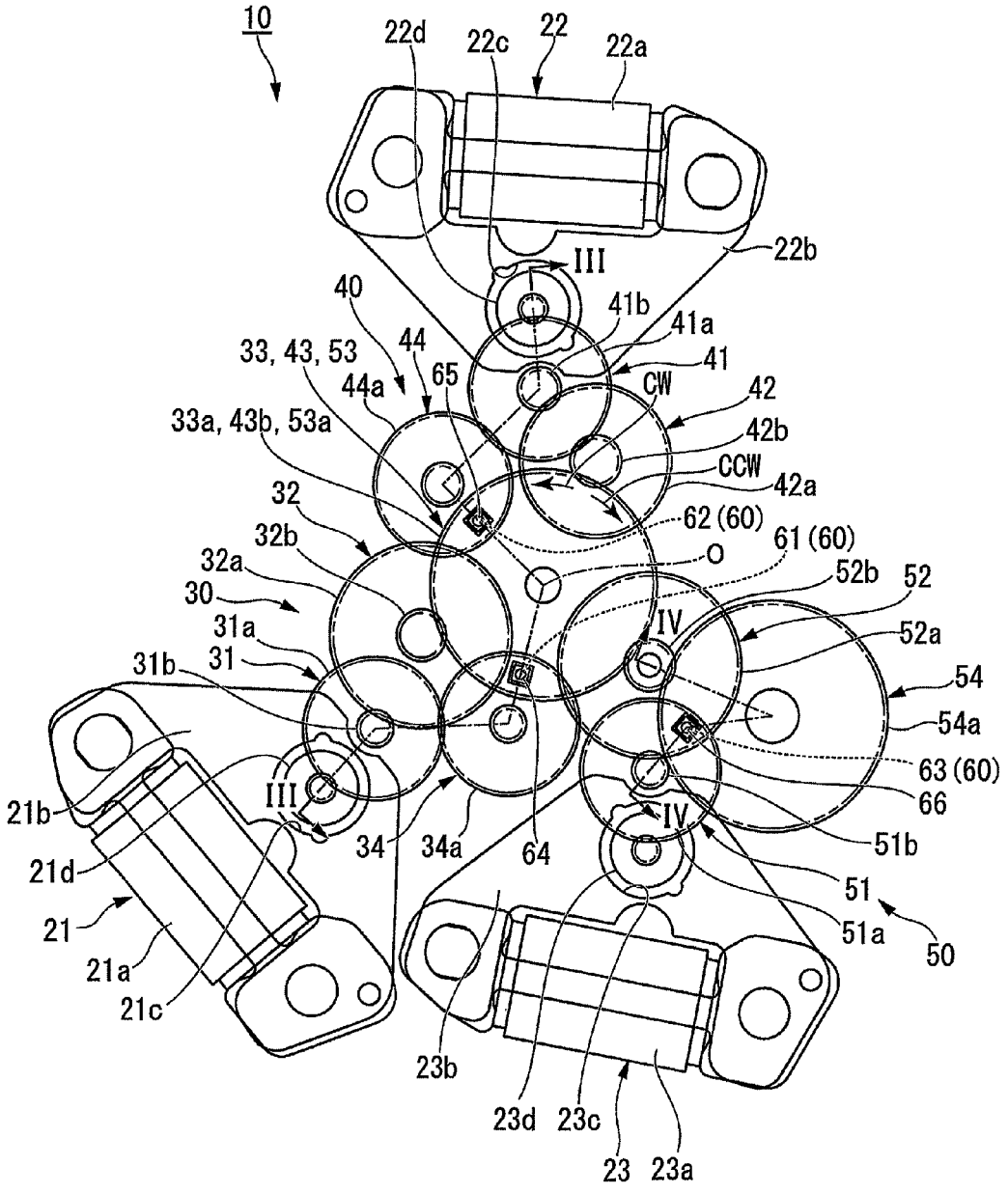
FIG. 2 is a plan view when a movement according to a first embodiment is viewed from a front side.
Figure 3:
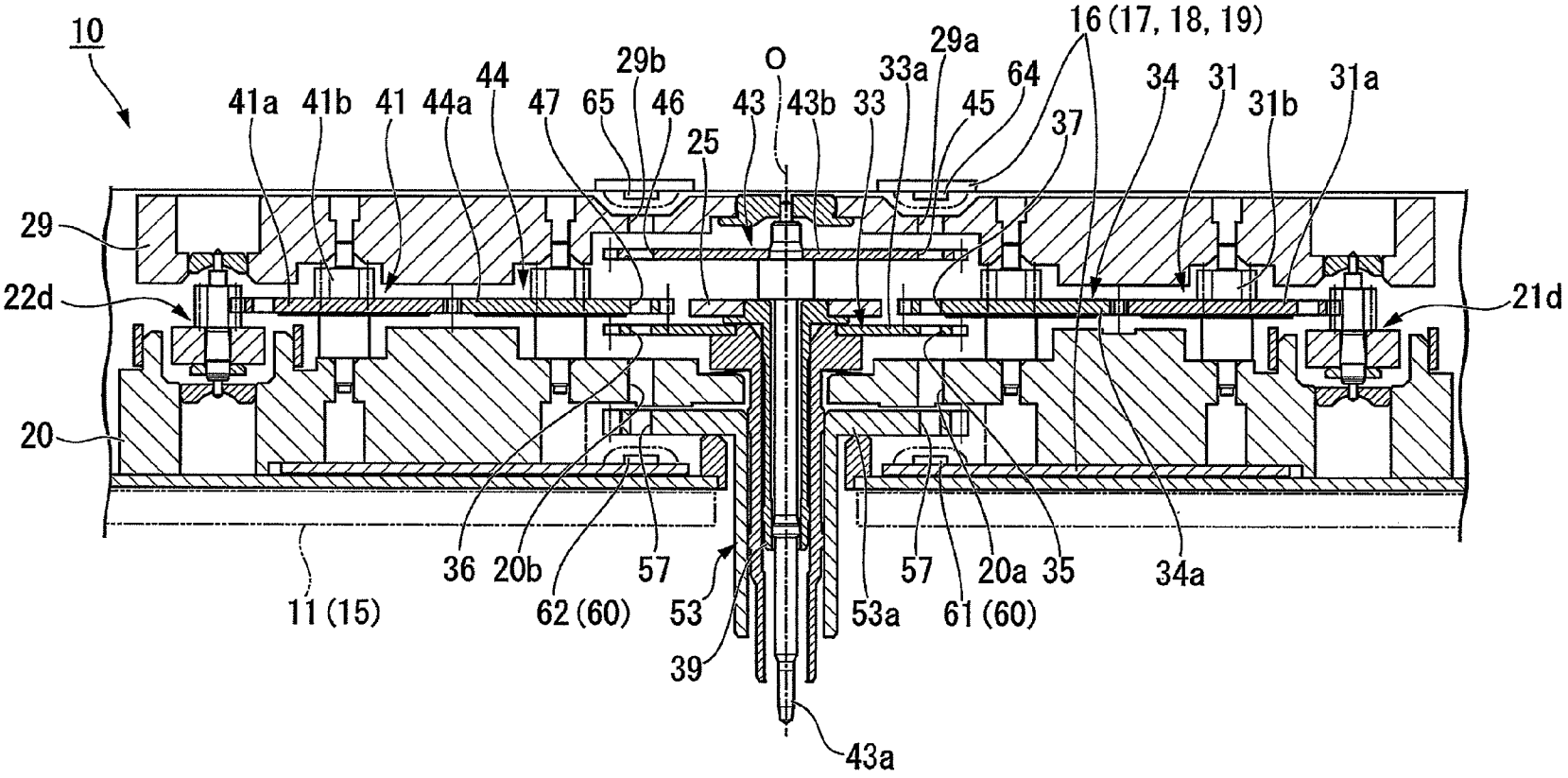
FIG. 3 is a sectional view taken along line III-III in FIG. 2.
Figure 4:
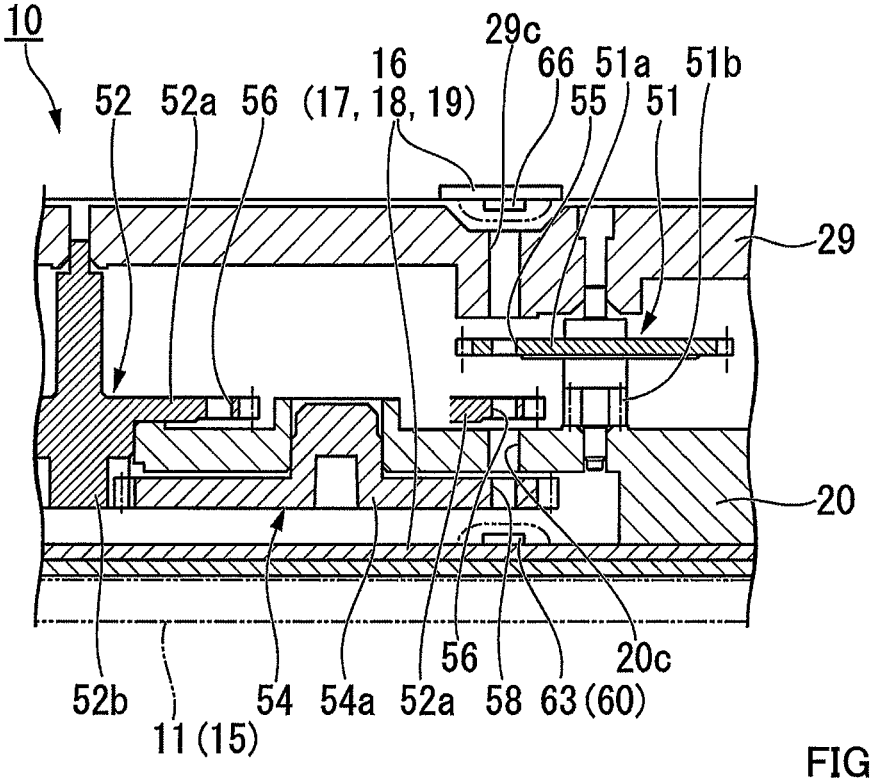
FIG. 4 is a sectional view taken along line IV-IV in FIG. 2.

FIG. 2 is plan view when the movement according to the first embodiment is viewed from the front side. FIG. 3 is a sectional view taken along line III-III in FIG. 2. FIG. 4 is a sectional view taken along line IV-IV in FIG. 2.

As illustrated in FIGS. 2 to 4, the movement 10 mainly includes a secondary battery (not illustrated), the control unit 16, a main plate 20, a train wheel bridge 29, the first stepping motor 21 (first drive source), the second stepping motor 22 (second drive source), the third stepping motor 23, a first train wheel 30, a second train wheel 40, a third train wheel 50, a light emitting element 60, a first light receiving element 64, a second light receiving element 65, and a third light receiving element 66.

The secondary battery (power source) is charged with power supplied from the solar panel 15, and supplies the power to the control unit 16.

The control unit 16 is a circuit board, and has an integrated circuit mounted thereon. For example, the integrated circuit is configured to include C-MOS or PLA. The control unit 16 includes a rotation control unit 17 for controlling the driving of the respective stepping motors 21, 22, and 23, a light emitting control unit 18 for controlling the light emitting of the light emitting element 60, and a detection control unit 19 for detecting light received by the respective light receiving elements 64, 65, and 66.

The main plate 20 configures the substrate of the movement 10. The dial 11 is arranged on the rear side of the main plate 20.

The train wheel bridge 29 is arranged on the front side of the main plate 20.

The light emitting element 60 includes a first light emitting element 61, a second light emitting element 62, and a third light emitting element 63.

As illustrated in FIG. 2, the respective stepping motors 21, 22, and 23 have coil blocks 21*a*, 22*a*, and 23*a* including a coil wire wound around a magnetic core, stators 21*b*, 22*b*, and 23*b* arranged so as to come into contact with both end portions of the magnetic core of the coil blocks 21*a*, 22*a*, and 23*a*, and rotors 21*d*, 22*d*, and 23*d* arranged in rotor holes 21*c*, 22*c*, and 23*c* of the stators 21*b*, 22*b*, and 23*b*. As illustrated in FIGS. 3 and 4, the respective rotors 21*d*, 22*d*, and 23*d* are rotatably supported by the main plate 20 and the train wheel bridge 29. The respective stepping motors 21, 22, and 23 are connected to the rotation control unit 17.

As illustrated in FIG. 2, the first train wheel 30 has a center wheel & pinion 33 (first gear) which is rotated by the power of the first stepping motor 21 so as to drive the minute hand 13, a first center intermediate wheel 31 and a second center intermediate wheel 32 which transmit the power of the first stepping motor 21 to the center wheel & pinion 33, and a minute detection wheel 34 (second position detecting gear) which is rotated by the power of the first stepping motor 21.

The first center intermediate wheel 31 has a first center intermediate gear 31*a* and a first center intermediate pinion 31*b*, and is rotatably supported by the main plate 20 and the train wheel bridge 29 (refer to FIG. 3). The first center intermediate gear 31*a* meshes with a pinion of the rotor 21*d* of the first stepping motor 21.

The second center intermediate wheel 32 has a second center intermediate gear 32*a* and a second center intermediate pinion 32*b*, and is rotatably supported by the main plate 20 and the train wheel bridge 29. The second center intermediate gear 32*a* meshes with the first center intermediate pinion 31*b* of the first center intermediate wheel 31.

As illustrated in FIG. 3, the center wheel & pinion 33 is externally and rotatably inserted into a central pipe 39. The central pipe 39 is held in a central wheel bridge 25 fixed to the main plate 20. In the following description, the extending direction of the center axle O of the center wheel & pinion 33 is referred to as the axial direction, the train wheel bridge 29 side (front side) along the axial direction is referred to as an upper side, and the main plate 20 side (rear side) is referred to as a lower side. In addition, as illustrated in FIG. 2, an arrow CW in the drawing indicates a direction turning clockwise around the center axle O when the movement 10 is viewed from below, and an arrow CCW indicates a direction turning counterclockwise around the center axle O when the movement 10 is viewed from below.

As illustrated in FIG. 2, the center wheel & pinion 33 has a center gear 33*a* which meshes with the second center intermediate pinion 32*b* of the second center intermediate wheel 32. For example, the center wheel & pinion 33 is configured to be rotated once if the first stepping motor 21 is rotated 360 steps. The rotation angle of the center wheel & pinion 33 which corresponds to one step of the first stepping motor 21 is set to 1°. The minute hand 13 is attached to a lower end portion of the center wheel & pinion 33.

Figure 5:
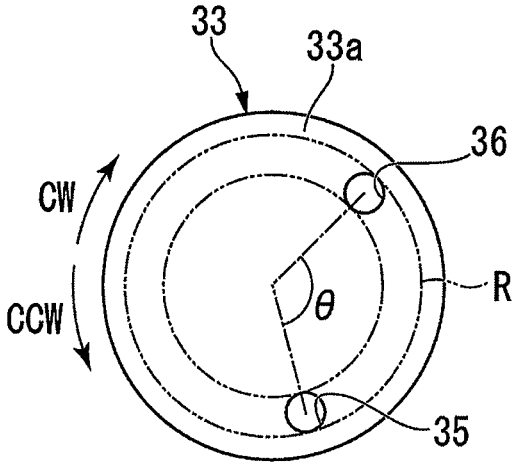
FIG. 5 is a plan view of a center wheel & pinion according to the first embodiment.

FIG. 5 is a plan view of the center wheel & pinion according to the first embodiment.

As illustrated in FIG. 5, the center wheel & pinion 33 has a first center wheel transmittable portion 35 (first transmittable portion) through which light is transmittable and a second center wheel transmittable portion 36 (second transmittable portion) through which the light is transmittable. The first center wheel transmittable portion 35 and the second center wheel transmittable portion 36 are circular through-holes formed in the same shape, for example. The second center wheel transmittable portion 36 is disposed on a rotation trajectory of the first center wheel transmittable portion 35, in other words, the second center wheel transmittable portion 36 is disposed at a position overlapping with a rotation locus of the first center wheel transmittable portion 35. The term of "rotation trajectory" described herein represents a region R through which the first center wheel transmittable portion 35 passes when the center wheel & pinion 33 is rotated (similar in the following description). A central angle θ formed between the first center wheel transmittable portion 35 and the second center wheel transmittable portion 36 is set to 120°, for example. A portion between the first center wheel transmittable portion 35 and the second center wheel transmittable portion 36 represents a portion corresponding to a side where a separated distance is shorter between the first center wheel transmittable portion 35 and the second center wheel transmittable portion 36 in the circumferential direction of the center wheel & pinion 33. In addition, in this manner, the central angle θ becomes smaller than 180°. The second center wheel transmittable portion 36 is disposed at a position where the second center wheel transmittable portion 36 is rotated as much as the angle θ in the direction CCW with respect to the first center wheel transmittable portion 35.

As illustrated in FIG. 3, the minute detection wheel 34 is rotatably supported by the main plate 20 and the train wheel bridge 29. As illustrated in FIG. 2, the minute detection wheel 34 is arranged so as to partially overlap the center wheel & pinion 33 when viewed in the axial direction. The minute detection wheel 34 has a minute detection gear 34*a*. The minute detection gear 34*a* meshes with the first center intermediate gear 31*a* of the first center intermediate wheel 31. For example, if the first stepping motor 21 is rotated 12 steps, the minute detection wheel 34 is configured to be rotated once. The rotation angle of the minute detection wheel 34 which corresponds to one step of the first stepping motor 21 is set to 30°. If the minute detection wheel 34 is rotated 30 times, the center wheel & pinion 33 is rotated once.

Figure 6:
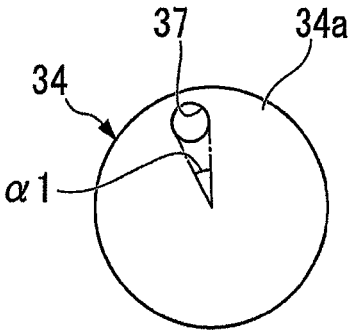
FIG. 6 is a plan view of a minute detection wheel according to the first embodiment.

FIG. 6 is a plan view of the minute detection wheel according to the first embodiment.

As illustrated in FIG. 6, the minute detection wheel 34 has a minute detection wheel transmittable portion 37 (sixth transmittable portion) through which the light is transmittable. The minute detection wheel transmittable portion 37 is a circular through-hole, for example. A central angle α1 corresponding to a portion between a pair of tangent lines passing through the rotation center of the minute detection wheel 34 in the tangent line of the minute detection wheel transmittable portion 37 in a plan view is set to be smaller than the rotation angle of the minute detection wheel 34 which corresponds to one step of the first stepping motor 21, for example.

As illustrated in FIG. 2, the second train wheel 40 has a second wheel & pinion 43 (second gear) which is rotated by the power of the second stepping motor 22 so as to drive the second hand 14, a sixth wheel 41 and a fifth wheel 42 which transmit the power of the second stepping motor 22 to the second wheel & pinion 43, and a second detection wheel 44 (first position detecting gear) which is rotated by the power of the second stepping motor 22.

The sixth wheel 41 has a sixth gear 41*a* and a sixth wheel pinion 41*b*, and is rotatably supported by the main plate 20 and the train wheel bridge 29 (refer to FIG. 3). The sixth gear 41*a* meshes with a pinion of the rotor 22*d* of the second stepping motor 22.

The fifth wheel 42 has a fifth gear 42*a* and a fifth wheel pinion 42*b*, and is rotatably supported by the main plate 20 and the train wheel bridge 29. The fifth gear 42*a* meshes with the sixth wheel pinion 41*b* of the sixth wheel 41.

The second wheel & pinion 43 is arranged coaxially with the center axle O. As illustrated in FIG. 3, the second wheel & pinion 43 has a wheel axle 43*a* and a second gear 43*b* fixed to the wheel axle 43*a*. The wheel axle 43*a* is rotatably inserted into the central pipe 39. The second hand 14 is attached to a lower end portion of the wheel axle 43*a*. As illustrated in FIG. 2, the second gear 43*b* meshes with the fifth wheel pinion 42*b* of the fifth wheel 42. For example, if the second stepping motor 22 is rotated 240 steps, the second wheel & pinion 43 is configured to be rotated once. The rotation angle of the second wheel & pinion 43 which corresponds to one step of the second stepping motor 22 is set to 1.5°.

Figure 7:
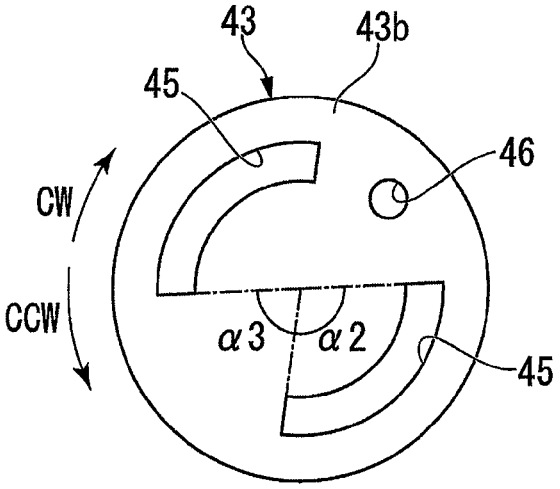
FIG. 7 is a plan view of a second wheel & pinion according to the first embodiment.

FIG. 7 is a plan view of the second wheel & pinion according to the first embodiment.

As illustrated in FIG. 7, the second wheel & pinion 43 has a pair of first second wheel transmittable portions 45 (third transmittable portion) through which the light is transmittable and a second second wheel transmittable portion 46 (fourth transmittable portion) through which the light is transmittable.

A pair of the first second wheel transmittable portions 45 are disposed on the rotation trajectory of the first center wheel transmittable portion 35 and the second center wheel transmittable portion 36 of the center wheel & pinion 33 when viewed in the axial direction. A pair of the first second wheel transmittable portions 45 respectively form long holes along the circumferential direction of the second wheel & pinion 43. A pair of the first second wheel transmittable portions 45 are symmetric with each other with respect to the center axle O. The dimension of the respective first second wheel transmittable portions 45 along the circumferential direction of the second wheel & pinion 43 is set to the dimension which is equal to or larger than the separated distance between end portions of a pair of the first second wheel transmittable portions 45 along the circumferential direction of the second wheel & pinion 43. A central angle $\alpha 2$ formed by both end portions of the respective first second wheel transmittable portions 45 is set to be equal to or larger than a central angle $\alpha 3$ between a pair of the first second wheel transmittable portions 45 along the circumferential direction of the second wheel & pinion 43. In the present embodiment, the central angle $\alpha 2$ is set to 100°. In addition, the central angle $\alpha 3$ is set to 80°.

The second second wheel transmittable portion 46 is disposed on the rotation trajectory of the first second wheel transmittable portion 45. For example, the second second wheel transmittable portion 46 is a circular through-hole having the same inner diameter as the width dimension of the first second wheel transmittable portion 45. The second second wheel transmittable portion 46 is disposed on the rotation trajectory of the first second wheel transmittable portion 45, at an intermediate position between a pair of the first second wheel transmittable portions 45.

As illustrated in FIG. 3, the second detection wheel 44 is rotatably supported by the main plate 20 and the train wheel bridge 29. As illustrated in FIG. 2, the second detection wheel 44 is arranged so as to partially overlap the second wheel & pinion 43 when viewed in the axial direction. The second detection wheel 44 has a second detection gear 44*a*. The second detection gear 44*a* meshes with the sixth gear 41*a* of the sixth wheel 41. The second detection wheel 44 is configured to be rotated once, for example, if the second stepping motor 22 is rotated 10 steps. The rotation angle of the second detection wheel 44 which corresponds to one step of the second stepping motor 22 is set to 36°. If the second detection wheel 44 is rotated 24 times, the second wheel & pinion 43 is rotated once.

Figure 8:
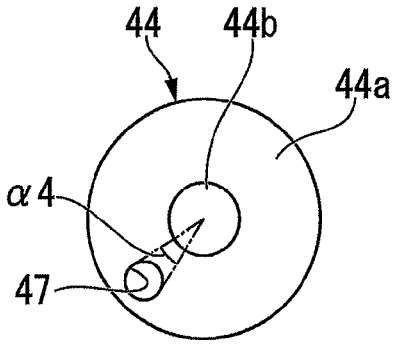
FIG. 8 is a plan view of a second detection wheel according to the first embodiment.

FIG. 8 is a plan view of the second detection wheel according to the first embodiment.

As illustrated in FIG. 8, the second detection wheel 44 has a second detection wheel transmittable portion 47 (fifth transmittable portion) through which the light is transmittable. The second detection wheel transmittable portion 47 is a circular through-hole, for example. A central angle $\alpha 4$ corresponding to a portion between a pair of tangent lines passing through the rotation center of the second detection wheel 44 in the tangent line of the second detection wheel transmittable portion 47 in a plan view is set to be smaller than the rotation angle of the second detection wheel 44 which corresponds to one step of the second stepping motor 22, for example.

As illustrated in FIG. 2, the third train wheel 50 has an intermediate minute wheel 51, a minute wheel 52, an hour wheel 53, and an hour detection wheel 54.

The intermediate minute wheel 51 has an intermediate minute gear 51*a* and an intermediate minute wheel pinion 51*b*, and is rotatably supported by the main plate 20 and the train wheel bridge 29 (refer to FIG. 4). The intermediate minute gear 51*a* meshes with a pinion of the rotor 23*d* of the third stepping motor 23.

Figure 9:
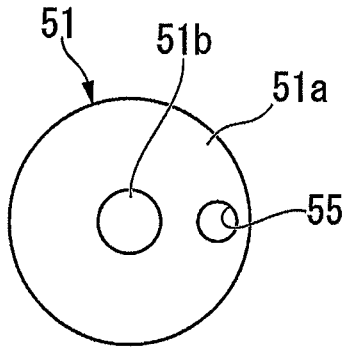
FIG. 9 is a plan view of an intermediate minute wheel according to the first embodiment.

FIG. 9 is a plan view of the intermediate minute wheel according to the first embodiment.

As illustrated in FIG. 9, the intermediate minute wheel 51 has an intermediate minute wheel transmittable portion 55 through which the light is transmittable. The intermediate minute wheel transmittable portion 55 is a circular through-hole.

As illustrated in FIG. 4, the minute wheel 52 is rotatably supported by the main plate 20 and the train wheel bridge 29. As illustrated in FIG. 2, the minute wheel 52 has a minute gear 52*a* and a minute wheel pinion 52*b*. The minute gear 52*a* meshes with the intermediate minute wheel pinion 51*b*. The minute gear 52*a* is arranged so as to overlap a portion of the intermediate minute gear 51*a* of the intermediate minute wheel 51 when viewed in the axial direction.

Figure 10:
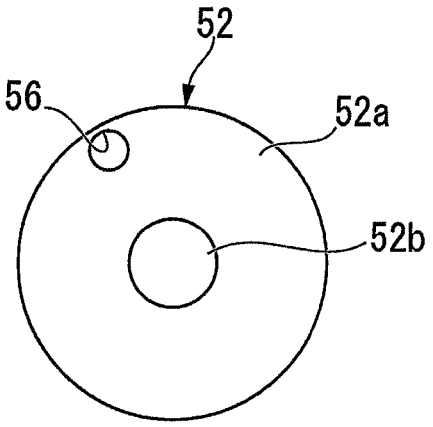
FIG. 10 is a plan view of a minute wheel according to the first embodiment.

FIG. 10 is a plan view of the minute wheel according to the first embodiment.

As illustrated in FIG. 10, the minute wheel 52 has a minute wheel transmittable portion 56 through which the light is transmittable. For example, the minute wheel transmittable portion 56 is formed in the same shape as the intermediate minute wheel transmittable portion 55 of the intermediate minute wheel 51 (refer to FIG. 9).

As illustrated in FIG. 3, the hour wheel 53 is arranged coaxially with the center axle O, and is rotatably and externally inserted into the center wheel & pinion 33. As illustrated in FIG. 2, the hour wheel 53 has an hour gear 53*a* which meshes with the minute wheel pinion 52*b* of the minute wheel 52. The hour hand 12 is attached to a lower end portion of the hour wheel 53.

Figure 11:
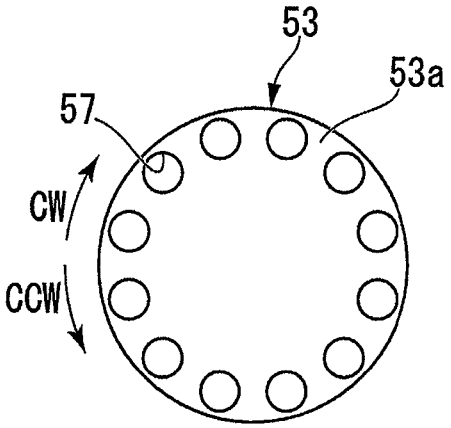
FIG. 11 is a plan view of an hour wheel according to the first embodiment.

FIG. 11 is a plan view of the hour wheel according to the first embodiment.

As illustrated in FIG. 11, the hour wheel 53 has 12 hour wheel transmittable portions 57 through which the light is transmittable. The 12 hour wheel transmittable portions 57 are circular through-holes, and are arrayed at equal intervals (interval of 30° in the present embodiment) along the circumferential direction of the hour wheel 53. The respective hour wheel transmittable portions 57 are disposed on the rotation trajectory of the first center wheel transmittable portion 35 of the center wheel & pinion 33 when viewed in the axial direction.

As illustrated in FIG. 4, the hour detection wheel 54 is rotatably supported by the main plate 20. As illustrated in FIG. 2, the hour detection wheel 54 is arranged so as to partially overlap a portion where the intermediate minute gear 51*a* of the intermediate minute wheel 51 overlaps the minute gear 52*a* of the minute wheel 52. The hour detection wheel 54 has an hour detection gear 54*a*. The hour detection gear 54*a* meshes with the minute wheel pinion 52*b* of the minute wheel 52.

Figure 12:
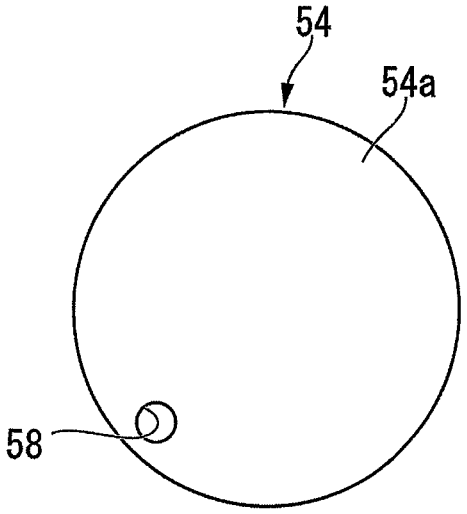
FIG. 12 is a plan view of an hour detection wheel according to the first embodiment.

FIG. 12 is a plan view of the hour detection wheel according to the first embodiment.

As illustrated in FIG. 12, the hour detection wheel 54 has an hour detection wheel transmittable portion 58 through which the light is transmittable. For example, the hour detection wheel transmittable portion 58 is formed in the same shape as the intermediate minute wheel transmittable portion 55 of the intermediate minute wheel 51 (refer to FIG. 9).

As illustrated in FIGS. 2 and 3, the first light emitting element 61 is arranged on the lower side in the axial direction with respect to the center wheel & pinion 33 and the second wheel & pinion 43, and is fixed to the main plate 20, for example. For example, the first light emitting element 61 is a light emitting diode (LED) or a laser diode (LD), and can emit the light upward. The first light emitting element 61 is connected to the light emitting control unit 18.

The first light receiving element 64 is arranged on the upper side in the axial direction, across the center wheel & pinion 33 and the second wheel & pinion 43, and is fixed to the train wheel bridge 29, for example. For example, the first light receiving element 64 is a photo diode, and detects the light emitted from the first light emitting element 61. The first light receiving element 64 is connected to the detection control unit 19.

Through-holes 20*a* and 29*a* respectively penetrating the main plate 20 and the train wheel bridge 29 in the axial direction are formed at a position corresponding to a portion between the first light emitting element 61 and the first light receiving element 64 (hereinafter, referred to as a "first detection position"). The light emitted from the first light emitting element 61 is incident on the first light receiving element 64 after passing through the through-holes 29*a* and 20*a*.

The center wheel & pinion 33, the minute detection wheel 34, the second wheel & pinion 43, and the hour wheel 53 are arranged at the first detection position. The first detection position overlaps the rotation trajectory of the first center wheel transmittable portion 35 and the second center wheel transmittable portion 36 of the center wheel & pinion 33 when viewed in the axial direction. In this manner, the first detection position overlaps the rotation trajectory of the first second wheel transmittable portion 45 and the second second wheel transmittable portion 46 of the second wheel & pinion 43 and the rotation trajectory of the hour wheel transmittable portion 57 of the hour wheel 53 when viewed in the axial direction. In addition, the first detection position overlaps the rotation trajectory of the minute detection wheel transmittable portion 37 of the minute detection wheel 34 when viewed in the axial direction.

When located at the first detection position, either the first center wheel transmittable portion 35 or the second center wheel transmittable portion 36 of the center wheel & pinion 33 can transmit the light emitted from the first light emitting element 61. In addition, when both the first center wheel transmittable portion 35 and the second center wheel transmittable portion 36 are located at a position other than the first detection position, the center wheel & pinion 33 blocks the light emitted from the first light emitting element 61.

When located at the first detection position, either the first second wheel transmittable portion 45 or the second second wheel transmittable portion 46 of the second wheel & pinion 43 can transmit the light emitted from the first light emitting element 61. In addition, when both the first second wheel transmittable portion 45 and the second second wheel transmittable portion 46 are located at a position other than the first detection position, the second wheel & pinion 43 blocks the light emitted from the first light emitting element 61.

When located at the first detection position, the hour wheel transmittable portion 57 of the hour wheel 53 can transmit the light emitted from the first light emitting element 61. In addition, when the hour wheel transmittable portion 57 is located at a position other than the first detection position, the hour wheel 53 blocks the light emitted from the first light emitting element 61.

When located at the first detection position, the minute detection wheel transmittable portion 37 of the minute detection wheel 34 can transmit the light emitted from the first light emitting element 61. In addition, when the minute detection wheel transmittable portion 37 is located at a position other than the first detection position, the minute detection wheel 34 blocks the light emitted from the first light emitting element 61.

The minute detection wheel transmittable portion 37 of the minute detection wheel 34 is disposed so as to be located at a position corresponding to the first center wheel transmittable portion 35 when viewed in the axial direction, in a predetermined state where the center wheel & pinion 33 can transmit the light emitted from the first light emitting element 61 to the first light receiving element 64 in the first center wheel transmittable portion 35. In addition, the minute detection wheel transmittable portion 37 of the minute detection wheel 34 is disposed so as to be located at a position corresponding to the second center wheel transmittable portion 36 when viewed in the axial direction, in a state where the center wheel & pinion 33 can transmit the light emitted from the first light emitting element 61 to the first light receiving element 64 in the second center wheel transmittable portion 36. That is, in a state where the first center wheel transmittable portion 35 is located at the first detection position and in a state where the second center wheel transmittable portion 36 is located at the first detection position, the minute detection wheel transmittable portion 37 is located at the first detection position.

The central angle θ (120°) between the first center wheel transmittable portion 35 and the second center wheel transmittable portion 36 in the center wheel & pinion 33 is integral multiplication of the rotation angle (12°) of the center wheel & pinion 33 per rotation of the minute detection wheel 34. In addition, the number of rotations of the minute detection wheel 34 per rotation of the center wheel & pinion 33 is 30 (that is, a gear ratio of the center wheel & pinion 33 with respect to the minute detection wheel 34 is 1/integer). Therefore, when the first center wheel transmittable portion 35 and the second center wheel transmittable portion 36 of the center wheel & pinion 33 are located at the first detection position, the minute detection wheel transmittable portion 37 of the minute detection wheel 34 is also located at the first detection position.

The second light emitting element 62 is arranged on the lower side in the axial direction with respect to the center wheel & pinion 33 and the second wheel & pinion 43, and is fixed to the main plate 20, for example. Similarly to the first light emitting element 61, the second light emitting element 62 is an LED or an LD, for example, and can emit the light upward. The second light emitting element 62 is connected to the light emitting control unit 18.

The second light receiving element 65 is disposed on the upper side in the axial direction, across the center wheel & pinion 33 and the second wheel & pinion 43, and is fixed to the train wheel bridge 29, for example. Similarly to the first light receiving element 64, the second light receiving element 65 is a photo diode, for example, and detects the light emitted from the second light emitting element 62. The second light receiving element 65 is connected to the detection control unit 19.

Through-holes 20*b* and 29*b* respectively penetrating the main plate 20 and the train wheel bridge 29 in the axial direction are formed at a position corresponding to a portion between the second light emitting element 62 and the second light receiving element 65 (hereinafter, referred to as a "second detection position"). The light emitted from the second light emitting element 62 is incident on the second light receiving element 65 after passing through the through-holes 29*b* and 20*b*.

The center wheel & pinion 33, the second wheel & pinion 43, the second detection wheel 44, and the hour wheel 53 are arranged at the second detection position. The second detection position overlaps the rotation trajectory of the first center wheel transmittable portion 35 and the second center wheel transmittable portion 36 of the center wheel & pinion 33 when viewed in the axial direction. In this manner, the second detection position overlaps the rotation trajectory of the first second wheel transmittable portion 45 and the second second wheel transmittable portion 46 of the second wheel & pinion 43 and the rotation trajectory of the hour wheel transmittable portion 57 of the hour wheel 53 when viewed in the axial direction. In addition, the second detection position overlaps the rotation trajectory of the second detection wheel transmittable portion 47 of the second detection wheel 44 when viewed in the axial direction. Furthermore, the second light receiving element 65 is disposed so as to be capable of detecting the light which is emitted from the second light emitting element 62 and transmitted through the second center wheel transmittable portion 36 in the predetermined state where the center wheel & pinion 33 can transmit the light emitted from the first light emitting element 61 to the first light receiving element 64 in the first center wheel transmittable portion 35. That is, the second detection position is disposed corresponding to a position of the second center wheel transmittable portion 36 in a state where the first center wheel transmittable portion 35 is located at the first detection position. The second detection position is disposed at a position where the second detection position is moved as much as 120° in the direction CCW along the circumferential direction around the center axle O with respect to the first detection position.

When located at the second detection position, either the first center wheel transmittable portion 35 or the second center wheel transmittable portion 36 of the center wheel & pinion 33 can transmit the light emitted from the second light emitting element 62. In addition, when both the first center wheel transmittable portion 33 and the second center wheel transmittable portion 36 are located at a position other than the second detection position, the center wheel & pinion 33 blocks the light emitted from the second light emitting element 62.

When located at the second detection position, either the first second wheel transmittable portion 45 or the second second wheel transmittable portion 46 of the second wheel & pinion 43 can transmit the light emitted from the second light emitting element 62. In addition, when both the first second wheel transmittable portion 45 and the second second wheel transmittable portion 46 are located at a position other than the second detection position, the second wheel & pinion 43 blocks the light emitted from the second light emitting element 62.

When located at the second detection position, the hour wheel transmittable portion 57 of the hour wheel 53 can transmit the light emitted from the second light emitting element 62. In addition, when the hour wheel transmittable portion 57 is located at a position other than the second detection position, the hour wheel 53 blocks the light emitted from the second light emitting element 62.

When located at the second detection position, the second detection wheel transmittable portion 47 of the second detection wheel 44 can transmit the light emitted from the second light emitting element 62. In addition, when the second detection wheel transmittable portion 47 is located at a position other than the second detection position, the second detection wheel 44 blocks the light emitted from the second light emitting element 62.

The second detection wheel transmittable portion 47 of the second detection wheel 44 is disposed so as to be located at a position corresponding to the second second wheel transmittable portion 46 when viewed in the axial direction, in a state where the second wheel & pinion 43 can transmit the light emitted from the second light emitting element 62 to the second light receiving element 65 in the second second wheel transmittable portion 46. That is, in a state where the second second wheel transmittable portion 46 is located at the second detection position, the second detection wheel transmittable portion 47 is located at the second detection position.

The number of rotations of the second detection wheel 44 per rotation of the second wheel & pinion 43 is 24 (that is, a gear ratio of the second wheel & pinion 43 with respect to the second detection wheel 44 is 1/integer). Therefore, when the second second wheel transmittable portion 46 of the second wheel & pinion 43 is located at the second detection position, the second detection wheel transmittable portion 47 of the second detection wheel 44 is also located at the second detection position.

As illustrated in FIGS. 2 and 4, the third light emitting element 63 is arranged on the lower side in the axial direction with respect to the intermediate minute wheel 51, the minute wheel 52, and the hour detection wheel 54, and is fixed to the main plate 20, for example. Similarly to the first light emitting element 61, the third light emitting element 63 is an LED or an LD, for example, and can emit the light upward. The third light emitting element 63 is connected to the light emitting control unit 18.

The third light receiving element 66 is disposed on the upper side in the axial direction, across the intermediate minute wheel 51, the minute wheel 52, and the hour detection wheel 54, and is fixed to the train wheel bridge 29, for example. Similarly to the first light receiving element 64, the third light receiving element 66 is a photo diode, for example, and detects the light emitted from the third light emitting element 63. The third light receiving element 66 is connected to the detection control unit 19.

Through-holes 20*c* and 29*c* respectively penetrating the main plate 20 and the train wheel bridge 29 in the axial direction are formed at a position corresponding to a portion between the third light emitting element 63 and the third light receiving element 66 (hereinafter, referred to as a "third detection position"). The light emitted from the third light emitting element 63 is incident on the third light receiving element 66 after passing through the through-holes 29*c* and 20*c*.

The third detection position overlaps the rotation trajectory of the intermediate minute wheel transmittable portion 55 of the intermediate minute wheel 51 when viewed in the axial direction. In addition, the third detection position overlaps the rotation trajectory of the minute wheel transmittable portion 56 of the minute wheel 52 when viewed in the axial direction. Furthermore, the third detection position overlaps the rotation trajectory of the hour detection wheel transmittable portion 58 of the hour detection wheel 54 when viewed in the axial direction.

When located at the third detection position, the intermediate minute wheel transmittable portion 55 of the intermediate minute wheel 51 can transmit the light emitted from the third light emitting element 63. In addition, when the intermediate minute wheel transmittable portion 55 is located at a position other than the third detection position, the intermediate minute wheel 51 blocks the light emitted from the third light emitting element 63.

When located at the third detection position, the minute wheel transmittable portion 56 of the minute wheel 52 can transmit the light emitted from the third light emitting element 63. In addition, when the minute wheel transmittable portion 56 is located at a position other than the third detection position, the minute wheel 52 blocks the light emitted from the third light emitting element 63.

When the hour detection wheel transmittable portion 58 of the hour detection wheel 54 is located at the third detection position, the hour detection wheel transmittable portion 58 can transmit the light emitted from the third light emitting element 63. In addition, when the hour detection wheel transmittable portion 58 is located at a position other than the third detection position, the hour detection wheel 54 blocks the light emitted from the third light emitting element 63.

The intermediate minute wheel transmittable portion 55 of the intermediate minute wheel 51 and the minute wheel transmittable portion 56 of the minute wheel 52 are located at the third detection position, in a state where the hour detection wheel transmittable portion 58 of the hour detection wheel 54 is located at the third detection position.

Hand Position Detection Operation

Next, a hand position detection operation according to the present embodiment will be described.

In the hand position detection operation, in order to detect the position of the hour hand 12, the minute hand 13, and the second hand 14, each rotation position of the center wheel & pinion 33, the second wheel & pinion 43, and the hour wheel 53 is detected. In the following description, description with regard to the position detection operation of the hour hand 12 will be omitted. In addition, the reference numeral of each configuration component in the following description is the same as that in FIGS. 2 to 12.

Figure 14:
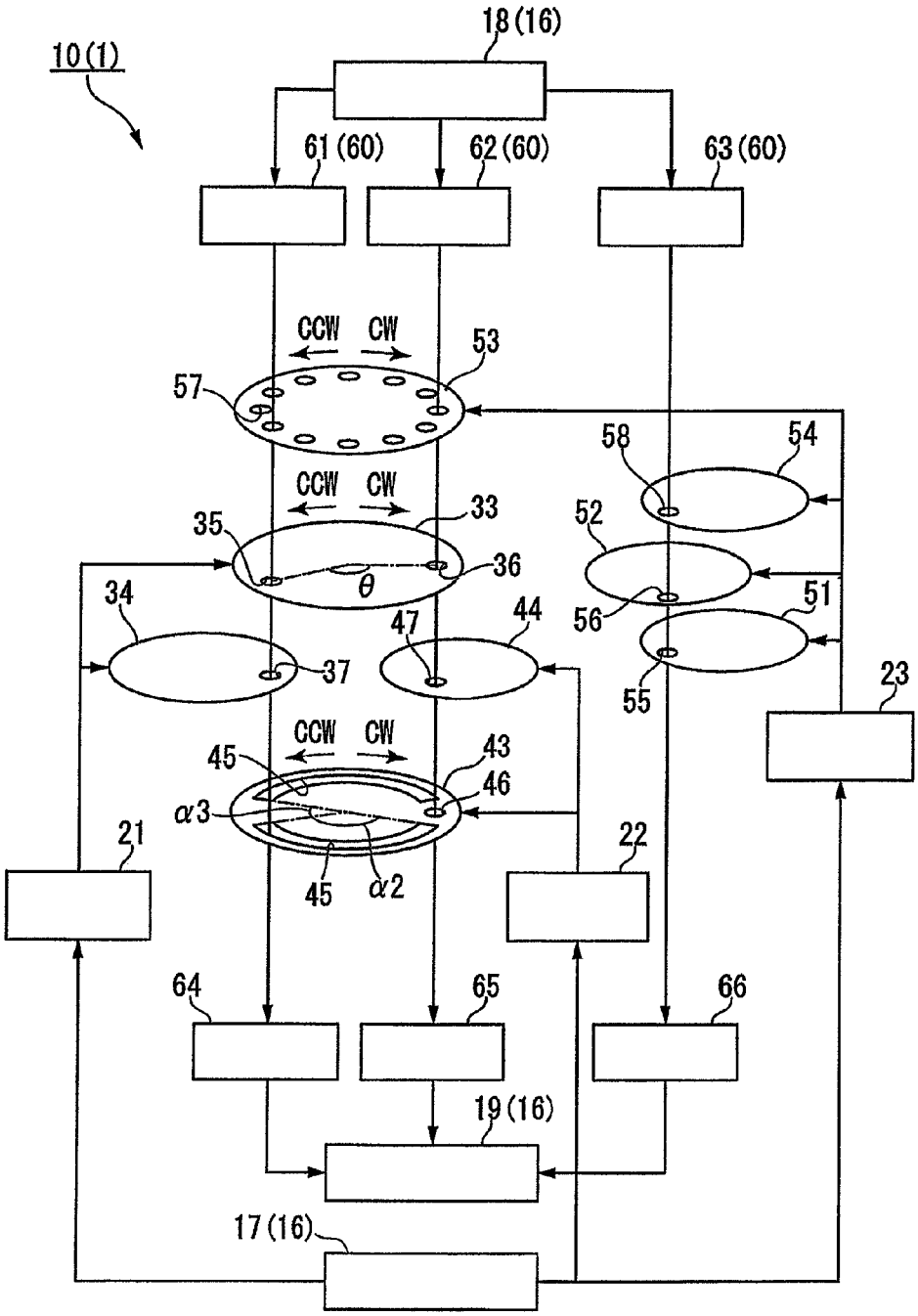
FIG. 14 is a block diagram of the movement according to the first embodiment.

FIG. 13 is a flowchart of the hand position detection operation according to the first embodiment. FIG. 14 is a block diagram schematically illustrating the movement according to the first embodiment. FIG. 14 schematically illustrates a state where the hand position detection operation is completed. As illustrated in FIG. 13, the hand position detection operation according to the present embodiment includes a minute transmitted state searching Step S10 of searching for the first center wheel transmittable portion 35 or the second center wheel transmittable portion 36 of the center wheel & pinion 33, a second transmitted state searching transfer Step S20 performed in a case where it is unclear whether either the first center wheel transmittable portion 35 or the second center wheel transmittable portion 36 is located at the first detection position when the minute transmitted state searching Step S10 is completed, and a second transmitted state searching Step S30 of searching for the second second wheel transmittable portion 46 of the second wheel & pinion 43.

First, before the above-described respective steps are performed, the hour wheel 53 is rotated by the third stepping motor 23 so that any one of the multiple hour wheel transmittable portions 57 is located at the first detection position. In this case, the multiple hour wheel transmittable portions 57 are arrayed at an interval of 30°. Accordingly, any one of the multiple hour wheel transmittable portions 57 is in a state of being also located at the second detection position.

Minute Transmitted State Searching Step

Next, the minute transmitted state searching Step S10 will be described.

The minute transmitted state searching Step S10 includes a transmitted state determination Step S11, a rotation angle determination Step S12, a first drive Step S13, a second drive Step S14, and Step S15.

In the minute transmitted state searching Step S10, the control unit 16 determines whether or not the first light receiving element 64 receives the light emitted from the first light emitting element 61 (transmitted state determination Step S11).

In the transmitted state determination Step S11, the light emitting control unit 18 of the control unit 16 supplies power to the first light emitting element 61 so as to emit the light from the first light emitting element 61. In addition, in the transmitted state determination Step S11, the detection control unit 19 of the control unit 16 operates the first light receiving element 64 so as to determine whether or not the first light receiving element 64 receives the light. In the transmitted state determination Step S11, when either the first center wheel transmittable portion 35 or the second center wheel transmittable portion 36 of the center wheel & pinion 33, either the first second wheel transmittable portion 45 or the second second wheel transmittable portion 46 of the second wheel & pinion 43, and the minute detection wheel transmittable portion 37 of the minute detection wheel 34 are located at the first detection position, the first light receiving element 64 detects the light emitted from the first light emitting element 61 (refer to FIG. 14).

In the transmitted state determination Step S11, in a case where the control unit 16 determines that the light emitted from the first light emitting element 61 is not transmitted through the center wheel & pinion 33 and the first light receiving element 64 does not receive the light emitted from the first light emitting element 61 (S11: No), the control unit 16 determines whether or not the rotation angle of the center wheel & pinion 33 is equal to or larger than 360°−θ (240° in the present embodiment) (rotation angle determination Step S12). In the rotation angle determination Step S12, the control unit 16 determines whether or not the rotation angle of the center wheel & pinion 33 after the hand position detection operation starts, which is stored in the control unit 16, is equal to or larger than 360°−θ. When the rotation angle determination Step S12 is performed for the first time, the rotation angle of the center wheel & pinion 33 which is stored in the control unit 16 is 0°.

In the rotation angle determination Step S12, in a case where the rotation control unit 17 determines that the rotation angle of the center wheel & pinion 33 is smaller than 360°−θ (S12: No), the rotation control unit 17 causes the first stepping motor 21 to perform one step rotation driving, and rotates the center wheel & pinion 33 in the direction CW as much as the rotation angle (1° in the present embodiment) corresponding to one step of the first stepping motor 21 (first drive Step S13). In the first drive Step S13, in response to the one step rotation driving of the first stepping motor 21, the minute detection wheel 34 is also rotated as much as the rotation angle (30° in the present embodiment) corresponding to one step of the first stepping motor 21. Subsequently, the transmitted state determination Step S11 is performed again.

Here, a case will be described where it is determined that the rotation angle of the center wheel & pinion 33 is equal to or larger than 360°−θ in the rotation angle determination Step S12 (S12: Yes).

Figure 15:
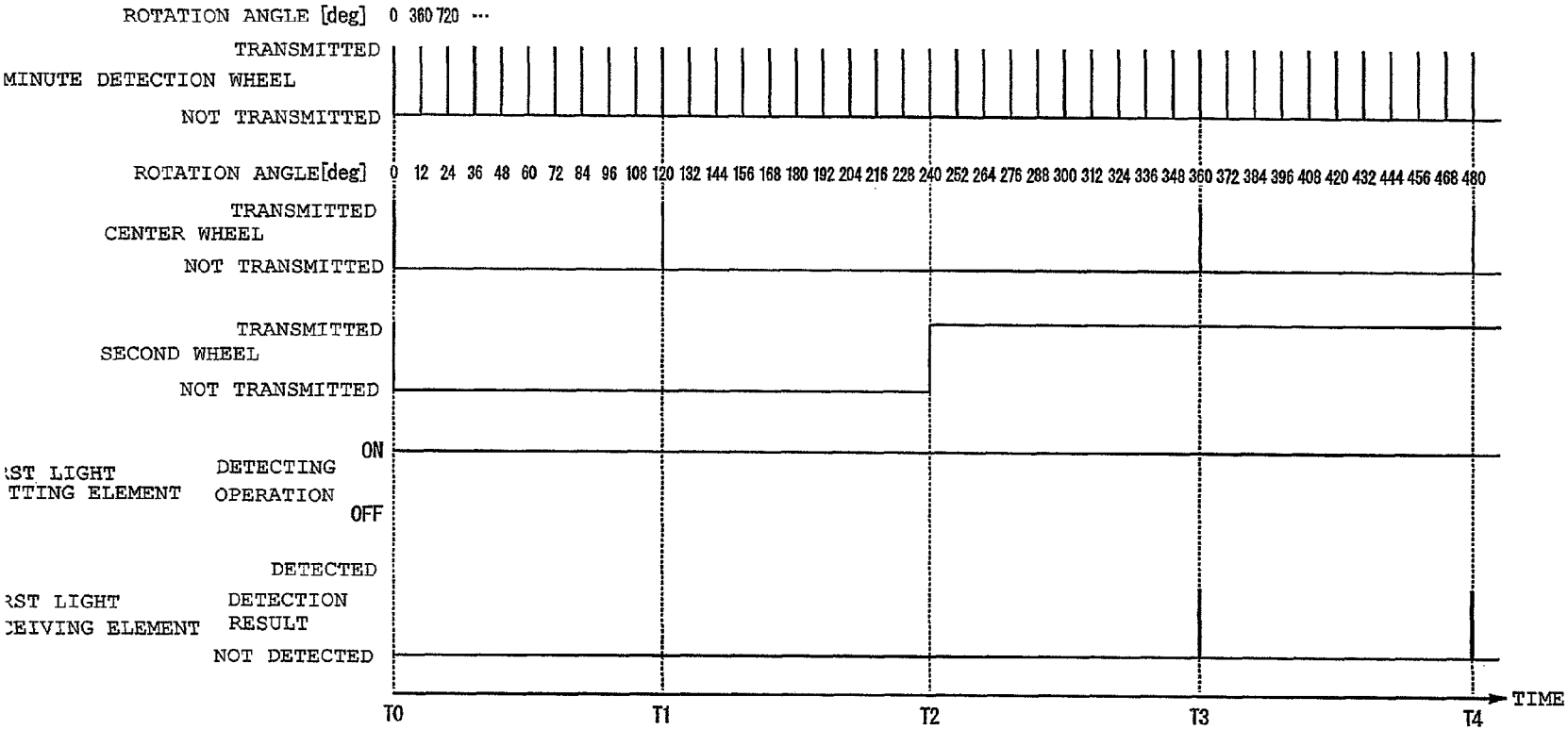
FIG. 15 is a timing chart illustrating a minute transmitted state searching step according to the first embodiment.

FIG. 15 is a timing chart illustrating the minute transmitted state searching step according to the first embodiment. A transmitted state in the minute detection wheel, the center wheel & pinion, and the second wheel & pinion in FIG. 15 represents a state where each transmittable portion belonging to the minute detection wheel, the center wheel & pinion, and the second wheel & pinion is located at the first detection position. In addition, a non-transmitted state represents a state where each transmittable portion belonging to the minute detection wheel, the center wheel & pinion, and the second wheel & pinion is located at a position other than the first detection position.

If the transmitted state determination Step S11, the rotation angle determination Step S12, and the first drive Step S13 are repeatedly performed, the center wheel & pinion 33 and the minute detection wheel 34 are rotated. As illustrated in FIG. 15, whenever the minute detection wheel 34 is rotated once, the minute detection wheel transmittable portion 37 of the minute detection wheel 34 passes through the first detection position once. Accordingly, whenever the minute detection wheel 34 is rotated once, the transmitted state and the non-transmitted state are repeated once. Whenever the center wheel & pinion 33 is rotated once, the first center wheel transmittable portion 35 and the second center wheel transmittable portion 36 of the center wheel & pinion 33 respectively pass through the first detection position once. Accordingly, whenever the center wheel & pinion 33 is rotated once, the transmitted state and the non-transmitted state are repeated twice. When the center wheel & pinion 33 is brought into the transmitted state, the minute detection wheel 34 is also brought into the transmitted state.

If the center wheel & pinion 33 is rotated as much as $360°-\theta$ at the most, at least any one of the first center wheel transmittable portion 35 and the second center wheel transmittable portion 36 passes through the first detection position (refer to FIG. 14). Therefore, even if the center wheel & pinion 33 is rotated as much as $360°-\theta$, in a case where the first light receiving element 64 does not detect the light emitted from the first light emitting element 61, the first second wheel transmittable portion 45 and the second second wheel transmittable portion 46 of the second wheel & pinion 43 are located at a position other than the first detection position.

As illustrated in FIG. 13, in the rotation angle determination Step S12, in a case where it is determined that the rotation angle of the center wheel & pinion 33 is equal to or larger than $360°-\theta$ (S12: Yes), the rotation control unit 17 drives the second stepping motor 22 so as to rotate the second wheel & pinion 43 as much as a predetermined angle $\beta$ (90° in the present embodiment) (second drive Step S14). In the present embodiment, a central angle $\alpha 2$ formed by both end portions of the first second wheel transmittable portion 45 is set to 100°, and a central angle $\alpha 3$ between a pair of the first second wheel transmittable portions 45 in the circumferential direction of the second wheel & pinion 43 is set to 80°. Therefore, by rotating the second wheel & pinion 43 as much as the predetermined angle $\beta$ (90° in the present embodiment) which is in a range from $\alpha 3$ to $\alpha 2$, the first second wheel transmittable portion 45 located at a position other than the first detection position can be moved so as to be located at the first detection position (time T2 in FIG. 15). Subsequently, the rotation angle of the center wheel & pinion 33 which is stored in the control unit 16 is set to 0°, and the transmitted state determination Step S11 is performed again. Thereafter, the rotation angle determination Step S12, the first drive Step S13, and the transmitted state determination Step S11 are repeatedly performed again. In this manner, the first light receiving element 64 can detect any one of the first center wheel transmittable portion 35 and the second center wheel transmittable portion 36 (time T3 in FIG. 15).

In the transmitted state determination Step S11, in a case where it is determined that the light emitted from the first light emitting element 61 is transmitted through the center wheel & pinion 33 and the first light receiving element 64 receives the light emitted from the first light emitting element 61 (S11: Yes), the control unit 16 determines whether or not the rotation angle of the center wheel & pinion 33 which is stored in the control unit 16 is equal to or larger than $\theta$ (120° in the present embodiment) (Step S15).

Here, a case will be described where the rotation angle of the center wheel & pinion 33 which is stored in the control unit 16 is equal to or larger than $\theta$ (S15: Yes).

When it is determined as Yes in the transmitted state determination Step S11, in a case where the first center wheel transmittable portion 35 is located at the first detection position, the rotation angle of the center wheel & pinion 33 which is stored in the control unit 16 in Step S15 is equal to or larger than 0° and smaller than $360°-\theta$. In addition, when it is determined as Yes in the transmitted state determination Step S11, in a case where the second center wheel transmittable portion 36 is located at the first detection position, the rotation angle of the center wheel & pinion 33 which is stored in the control unit 16 in Step S15 is equal to or larger than 0° and smaller than $\theta$. Therefore, in a case where it is determined as Yes in Step S15, the first center wheel transmittable portion 35 is located at the first detection position. In addition, the second center wheel transmittable portion 36 is located at the second detection position.

As described above, in a case where it is determined as Yes in Step S15, the rotation position of the center wheel & pinion 33 can be detected. Accordingly, the minute transmitted state searching step S10 is completed, and the process is transferred to the second transmitted state searching Step S30. In a case where it is determined as No in Step S15, it is not possible to determine that either the first center wheel transmittable portion 35 or the second center wheel transmittable portion 36 is located at the first detection position. Accordingly, the minute transmitted state searching Step S10 is completed, and the process is transferred to the second transmitted state searching transfer Step S20.

Second Transmitted State Searching Transfer Step

Next, the second transmitted state searching transfer Step S20 will be described.

The second transmitted state searching transfer Step 320 includes Step S21, Step S22, Step S23, and Step S24.

In the second transmitted state searching transfer Step S20, the rotation control unit 17 drives the first stepping motor 21 so that the center wheel & pinion 33 performs rotation driving in the direction CW as much as the angle $\theta$ (Step S21). In a case where the first center wheel transmittable portion 35 is located at the first detection position when Step S21 is performed, Step S21 is performed so as to move the second center wheel transmittable portion 36 to the first detection position. In a case where the second center wheel transmittable portion 36 is located at the first detection position when Step S21 is performed, Step S21 is performed so as to move the first center wheel transmittable portion 35 and the second center wheel transmittable portion 36 to a position other than the first detection position.

Next, similarly to the transmitted state determination Step S11, the control unit 16 determines whether or not the first light receiving element 64 receives the light emitted from the first light emitting element 61 (Step S22).

In Step S22, in a case where the control unit 16 determines that the light emitted from the first light emitting element 61 is transmitted through the center wheel & pinion 33 and the first light receiving element 64 receives the light emitted from the first light emitting element 61 (S22: Yes), the second center wheel transmittable portion 36 is located at the first detection position at that time. Accordingly, the center wheel & pinion 33 is caused to perform rotation driving in the direction CW as much as 360°−θ(Step S23). In this manner, the first center wheel transmittable portion 35 can be moved to the first detection position. In addition, the second center wheel transmittable portion 36 can be moved to the second detection position. Through the above-described processes, the rotation position of the center wheel & pinion 33 is completely detected. After Step S23 is performed, the second transmitted state searching transfer Step S20 is completed, and the process is transferred to the second transmitted state searching Step S30.

In Step S22, in a case where the light emitted from the first light emitting element 61 is not transmitted through the center wheel & pinion 33 and the first light receiving element 64 does not receive the light emitted from the first light emitting element 61 (S22: No), the second center wheel transmittable portion 36 is located at the first detection position when Step S21 is performed. Accordingly, the center wheel & pinion 33 is caused to perform rotation driving in the direction CW as much as the angle θ (Step S24). In this manner, the first center wheel transmittable portion 35 can be moved to the first detection position. In addition, the second center wheel transmittable portion 36 can be moved to the second detection position. Through the above-described processes, the rotation position of the center wheel & pinion 33 is completely detected. After Step S24 is performed, the second transmitted state searching transfer Step S20 is completed, and the process is transferred to the second transmitted state searching Step S30.

Second Transmitted State Searching Step

Next, the second transmitted state searching Step S30 will be described.

The second transmitted state searching Step S30 includes Step S31 and Step S32.

Figure 16:
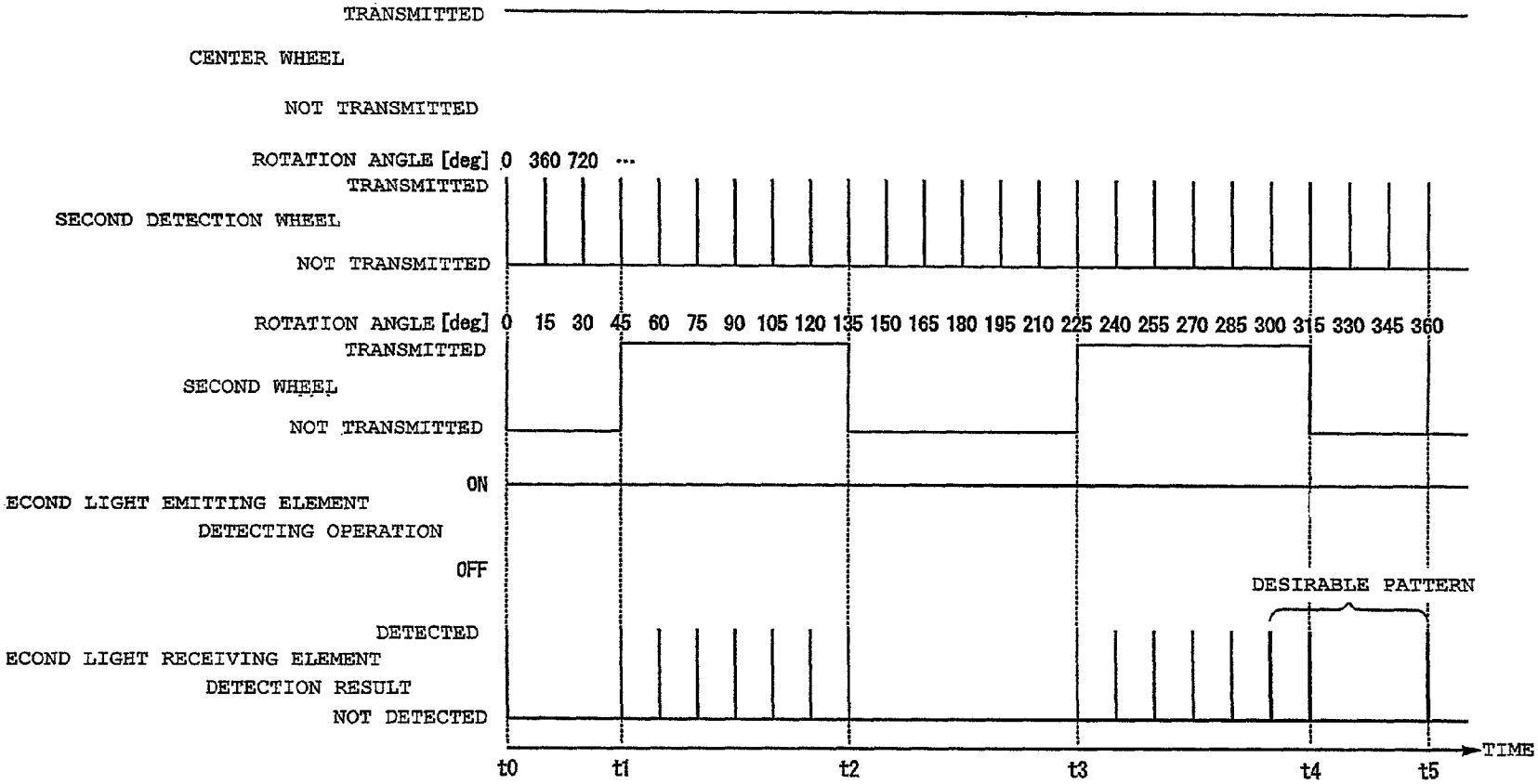
FIG. 16 is a timing chart illustrating a second transmitted state searching step according to the first embodiment.

FIG. 16 is a timing chart of the second transmitted state searching step according to the first embodiment. A transmitted state in the center wheel & pinion, the second detection wheel, and the second wheel & pinion in FIG. 16 represents a state where each transmittable portion belonging to the center wheel & pinion, the second detection wheel, and the second wheel & pinion is located at the second detection position. In addition, a non-transmitted state represents a state where each transmittable portion belonging to the center wheel & pinion, the second detection wheel, and the second wheel & pinion is located at a position other than the second detection position.

First, the second transmitted state searching Step S30 will be schematically described. As illustrated in FIG. 16, in the second transmitted state searching Step S30, the rotation control unit 17 drives the second stepping motor 22. While the second wheel & pinion 43 is rotated, the second light receiving element 65 is caused to receive the light emitted from the second light emitting element 62. In this case, the second light receiving element 65 is caused to detect a light transmission pattern corresponding to a shape, a position, and the number of the first second wheel transmittable portions 45 and the second second wheel transmittable portions 46. Then, the second second wheel transmittable portion 46 is detected by determining whether or not the light transmission pattern detected in the second light receiving element 65 is a desirable pattern. In this manner, the rotation position of the second wheel & pinion 43 is detected.

Hereinafter, the second transmitted state searching Step S30 will be described in detail.

In the second transmitted state searching Step S30, detecting the rotation position of the center wheel & pinion 33 is completed. Therefore, as illustrated in FIG. 14, the second center wheel transmittable portion 36 of the center wheel & pinion 33 is located at the second detection position. Accordingly, as illustrated in FIG. 16, the center wheel & pinion 33 is always in a transmitted state.

As illustrated in FIG. 13, in the second transmitted state searching Step S30, the control unit 16 detects a first desirable pattern (Step S31). In Step S31, the control unit 16 determines whether or not a signal detected in the second light receiving element 65 is the first desirable pattern.

In Step S31, in a case where it is determined that the first desirable pattern is not detected (S31: No), the rotation control unit 17 causes the second stepping motor 22 to perform one step rotation driving, and rotates the second wheel & pinion 43 in the direction CW as much as the rotation angle (1.5° in the present embodiment) corresponding to one step of the second stepping motor 22 (Step S32). In Step S32, in response to the one step rotation driving of the second stepping motor 22, the second detection wheel 44 is also rotated as much as the rotation angle (36° in the present embodiment) corresponding to one step of the second stepping motor 22. Subsequently, the first desirable pattern is detected again (Step S31).

A signal detected by the second light receiving element 65 in the second transmitted state searching Step S30 according to the present embodiment will be described. As illustrated in FIGS. 14 and 16, if Step S31 and Step S32 are repeatedly performed, the second wheel & pinion 43 and the second detection wheel 44 are rotated. The second detection wheel transmittable portion 47 of the second detection wheel 44 passes through the second detection position once, whenever the second detection wheel 44 is rotated once. Accordingly, the second detection wheel 44 repeats a transmitted state and a non-transmitted state once, whenever the second detection wheel 44 is rotated once. A pair of the first second wheel transmittable portion 45 and the second second wheel transmittable portion 46 of the second wheel & pinion 43 respectively pass through the second detection position once, whenever the second wheel & pinion 43 is rotated once. The second wheel & pinion 43 has the first second wheel transmittable portion 45 having a long hole. Accordingly, the second wheel & pinion 43 is in a continuously transmitted state over a period while the first second wheel transmittable portion 45 is located at the second detection position (refer to a period from time t1 to time t2 and a period from time t3 to time t4 in FIG. 16).

In the second transmitted state searching Step S30, the center wheel & pinion 33 and the hour wheel 53 are always in a transmitted state. Therefore, when both the second wheel & pinion 43 and the second detection wheel 44 are in the transmitted state, the second light receiving element 65 detects the light emitted from the second light emitting element 62. According to the present embodiment, when the first second wheel transmittable portion 45 passes through the second detection position, whenever the second wheel & pinion 43 is rotated as much as 15°, the second light receiving element 65 detects the light emitted from the second light emitting element 62.

If one first second wheel transmittable portion 45 completely passes through the second detection position, the second wheel & pinion 43 is rotated as much as 90° until the second light receiving element 65 starts to detect the light transmitted through the other first second wheel transmittable portion 45 (for example, a period from time t2 to time t3 in FIG. 16).

Here, a case will be described where the second second wheel transmittable portion 46 is present between one first second wheel transmittable portion 45 and the other first second wheel transmittable portion 45. In this case, after the second light receiving element 65 finally detects the light transmitted through one first second wheel transmittable portion 45, Step S31 and Step S32 are repeatedly performed. In this manner, if the second wheel & pinion 43 is rotated as much as 45°, the second second wheel transmittable portion 46 is brought into a state of being located at the second detection position. In this case, the second light receiving element 65 detects once the light transmitted through the second second wheel transmittable portion 46 (time t5 in FIG. 16).

In order to detect the second second wheel transmittable portion 46, the control unit 16 sets the light transmission pattern (first desirable pattern) to be detected by the second light receiving element 65 to be a pattern showing "detected-detected-not detected-not detected-detected", whenever the second wheel & pinion 43 is rotated as much as 15°. In this manner, when the second light receiving element 65 detects the first desirable pattern, the control unit 16 can determine that the second second wheel transmittable portion 46 is in a state of being located at the second detection position after one first second wheel transmittable portion 45 passes through the second detection position.

As described above, in Step S31, in a case where it is determined that the first desirable pattern is detected (S31: Yes), at that time, the second second wheel transmittable portion 46 is located at the second detection position. Accordingly, detecting the rotation position of the second wheel & pinion 43 is completed. Subsequently, the second transmitted state searching Step S30 is completed, and the hand position detection operation is completed.

As described above, according to the present embodiment, the first center wheel transmittable portion 35 and the second center wheel transmittable portion 36 are disposed in the center wheel & pinion 33. The first second wheel transmittable portion 45 is disposed in the second wheel & pinion 43 arranged coaxially with the center axle O. When the rotation position of the center wheel & pinion 33 is detected in order to detect the position of the minute hand 13, the light emitted from the first light emitting element 61 is transmitted through either the first center wheel transmittable portion 35 or the second center wheel transmittable portion 36, and the first second wheel transmittable portion 45, and is detected by the first light receiving element 64.

In a case where the first second wheel transmittable portion 45 is located at a position other than the first detection position, the light emitted from the first light emitting element 61 is blocked by the second wheel & pinion 43. In this case, even if either the first center wheel transmittable portion 35 or the second center wheel transmittable portion 36 is located at the first detection position, the first light receiving element 64 cannot detect the light emitted from the first light emitting element 61, and cannot detect the position of the center wheel & pinion 33.

According to the present embodiment, the center wheel & pinion 33 has the first center wheel transmittable portion 35 and the second center wheel transmittable portion 36 which are disposed on the same rotation trajectory and through which the light emitted from the first light emitting element 61 is transmittable. Accordingly, when the central angle between the first center wheel transmittable portion 35 and the second center wheel transmittable portion 36 is set to θ, the center wheel & pinion 33 is rotated as much as 360°−θ. In this manner, either the first center wheel transmittable portion 35 or the second center wheel transmittable portion 36 passes through the first detection position. Therefore, it is possible to determine whether or not the first second wheel transmittable portion 45 is located at the first detection position by rotating the center wheel & pinion 33 as much as 360°−θ. Accordingly, compared to a configuration in which the center wheel & pinion 33 is rotated as much as 360° as in the related art, it is possible to quickly determine whether or not the first second wheel transmittable portion 45 is located at the first detection position. Therefore, it is possible to shorten a time for operating the first light emitting element 61, and thus, it is possible to reduce power consumption when a hand position is detected.

In addition, the first second wheel transmittable portion 45 is a long hole along the circumferential direction of the second wheel & pinion 43. Accordingly, it is possible to increase probability that the first second wheel transmittable portion 45 may be located at the first detection position. Moreover, the dimension of the respective first second wheel transmittable portions 45 along the circumferential direction of the second wheel & pinion 43 is equal to or greater than the dimension between the end portions of the first second wheel transmittable portion 45 along the circumferential direction of the second wheel & pinion 43 in the region other than the first second wheel transmittable portion 45. Therefore, in a case where the respective first second wheel transmittable portions 45 are located at a position other than the first detection position, the second wheel & pinion 43 is rotated as much as the central angle corresponding to the portion between the end portions of the first second wheel transmittable portion 45 in a region other than the first second wheel transmittable portion 45 that is, as much as an angle equal to or larger than the central angle α3 (80° in the present embodiment) between a pair of the first second wheel transmittable portions 45, and the central angle corresponding to the first second wheel transmittable portions 45, that is, as much as an angle equal to or smaller than the central angle α2 (100° in the present embodiment) formed between both end portions of the respective first second wheel transmittable portions 45 (90° in the present embodiment). In this manner, the first second wheel transmittable portion 45 can be moved to the first detection position. Accordingly, the light emitted from the first light emitting element 61 is transmitted through either the first center wheel transmittable portion 35 or the second center wheel transmittable portion 36, and the first second wheel transmittable portion 45. Accordingly, the light emitted from the first light emitting element 61 can be more quickly detected by the first light receiving element 64. Therefore, it is possible to shorten a time for operating the first light emitting element 61, and thus, it is possible to reduce power consumption when a hand position is detected.

In addition, according to the present embodiment, in a predetermined state where the center wheel & pinion 33 can transmit the light emitted from the first light emitting element 61 to the first light receiving element 64 in the first center wheel transmittable portion 35, the light emitted from the second light emitting element 62 can be detected by the second light receiving element 65 after being transmitted through the second center wheel transmittable portion 36 of the center wheel & pinion 33. Accordingly, after the rotation position of the center wheel & pinion 33 is completely detected and the center wheel & pinion 33 is brought into the predetermined state, the light emitted from the second light emitting element 62 and transmitted through the second center wheel transmittable portion 36 and the second second wheel transmittable portion 46 is detected by the second light receiving element 65. In this manner, for example, even in a case where multiple first second wheel transmittable portions 45 are disposed at equal intervals, it is possible to detect the rotation position of the second wheel & pinion 43. In this case, while the second wheel & pinion 43 is rotated, the first second wheel transmittable portion 45 and the second second wheel transmittable portion 46 are caused to pass through the second detection position. A transmission pattern of the light which corresponds to a shape, a position, or the number of the first second wheel transmittable portions 45 and the second second wheel transmittable portions 46 is detected by the second light receiving element 65. In this manner, the second second wheel transmittable portion 46 of the second wheel & pinion 43 is identified in a state where the second second wheel transmittable portion 46 is distinguished from the first second wheel transmittable portion 45. Therefore, it is possible to detect the rotation position of the second wheel & pinion 43.

In addition, for example, in a case where the second hand 14 is driven using multi-Hz, depending on the rotation angle of the second wheel & pinion 43 for one step of the second stepping motor 22, it may become necessary to rotate the second stepping motor 22 several steps in order for the second second wheel transmittable portion 46 located at the second detection position to completely withdraw from the second detection position.

According to the present embodiment, there is provided the second detection wheel 44 having the second detection wheel transmittable portion 47 located at a position corresponding to the second second wheel transmittable portion 46, when the second second wheel transmittable portion 46 is located at a position corresponding to the second center wheel transmittable portion 36 of the center wheel & pinion 33 in the predetermined state when viewed in the axial direction. A gear ratio of the second wheel & pinion 43 with respect to the second detection wheel 44 is set to be smaller than 1. In this manner, the rotation angle (36° in the present embodiment) of the second detection wheel 44 for one step of the second stepping motor 22 can become larger than the rotation angle (1.5° in the present embodiment) of the second wheel & pinion 43. In this manner, the second detection wheel transmittable portion 47 located at the second detection position can completely withdraw from the second detection position by rotating the second stepping motor 22 one step. Accordingly, even in a case where it is necessary to rotate the second stepping motor 22 several steps in order for the second second wheel transmittable portion 46 located at the second detection position to completely withdraw from the second detection position, the light emitted from the second light emitting element 62 can be blocked in a region other than the second detection wheel transmittable portion 47 of the second detection wheel 44. Accordingly, one step of the second stepping motor 22 enables the second light receiving element 65 to be transferred between a state where the light emitted from the second light emitting element 62 can be detected and a state where the light cannot be detected. Therefore, it is possible to reliably detect the rotation position of the second wheel & pinion 43 in response to the position detection of the second hand 14.

In addition, depending on the rotation angle of the center wheel & pinion 33 for one step of the first stepping motor 21, it may become necessary to rotate the first stepping motor 21 several steps in order for the first center wheel transmittable portion 35 or the second center wheel transmittable portion 36 located at the first detection position to completely withdraw from the first detection position.

According to the present embodiment, the minute detection wheel transmittable portion 37 belonging to the minute detection wheel 34 is disposed at a position corresponding to the first center wheel transmittable portion 35 when viewed in the axial direction, in a state where the center wheel & pinion 33 can transmit the light emitted from the first light emitting element 61 to the first light receiving element 64 in the first center wheel transmittable portion 35. In addition, the minute detection wheel transmittable portion 37 is disposed at a position corresponding to the second center wheel transmittable portion 36 when viewed in the axial direction, in a state where the center wheel & pinion 33 can transmit the light emitted from the first light emitting element 61 to the first light receiving element 64 in the second center wheel transmittable portion 36. A gear ratio of the center wheel & pinion 33 with respect to the minute detection wheel 34 is set to be smaller than 1. In this manner, the rotation angle (30° in the present embodiment) of the minute detection wheel 34 for one step of the first stepping motor 21 can become larger than the rotation angle (1° in the present embodiment) of the center wheel & pinion 33. In this manner, the minute detection wheel transmittable portion 37 located at the first detection position can completely withdraw from the first detection position by rotating the first stepping motor 21 one step. Accordingly, even in a case where it is necessary to rotate the first stepping motor 21 several steps in order for the first center wheel transmittable portion 35 or the second center wheel transmittable portion 36 located at the first detection position to completely withdraw from the first detection position, the light emitted from the first light emitting element 61 can be blocked in a region other than the minute detection wheel transmittable portion 37 of the minute detection wheel 34. Accordingly, one step of the first stepping motor 21 enables the first light receiving element 64 to be transferred between a state where the light emitted from the first light emitting element 61 can be detected and a state where the light cannot be detected. Therefore, it is possible to reliably detect the rotation position of the center wheel & pinion 33 in response to the position detection of the minute hand 13.

In addition, the control unit 16 repeatedly rotates the center wheel & pinion 33 in the first drive Step S13, and performs the second drive Step S14, when the control unit 16 determines that the rotation angle of the center wheel & pinion 33 is equal to or larger than 360°−θ, in the rotation angle determination Step S12. Accordingly, compared to a configuration in which the center wheel & pinion 33 is rotated as much as 360° as in the related art, it is possible to quickly determine whether or not the first second wheel transmittable portion 45 is located at the first detection position. Therefore, it is possible to shorten a time for operating the first light emitting element 61, and thus, it is possible to reduce power consumption when a hand position is detected.

The electronic timepiece 1 according to the present embodiment includes the above-described movement 10. Accordingly, it is possible to reduce the power consumption when the hand position is detected.

Second Embodiment

Next, a second embodiment will be described.

Figure 17:
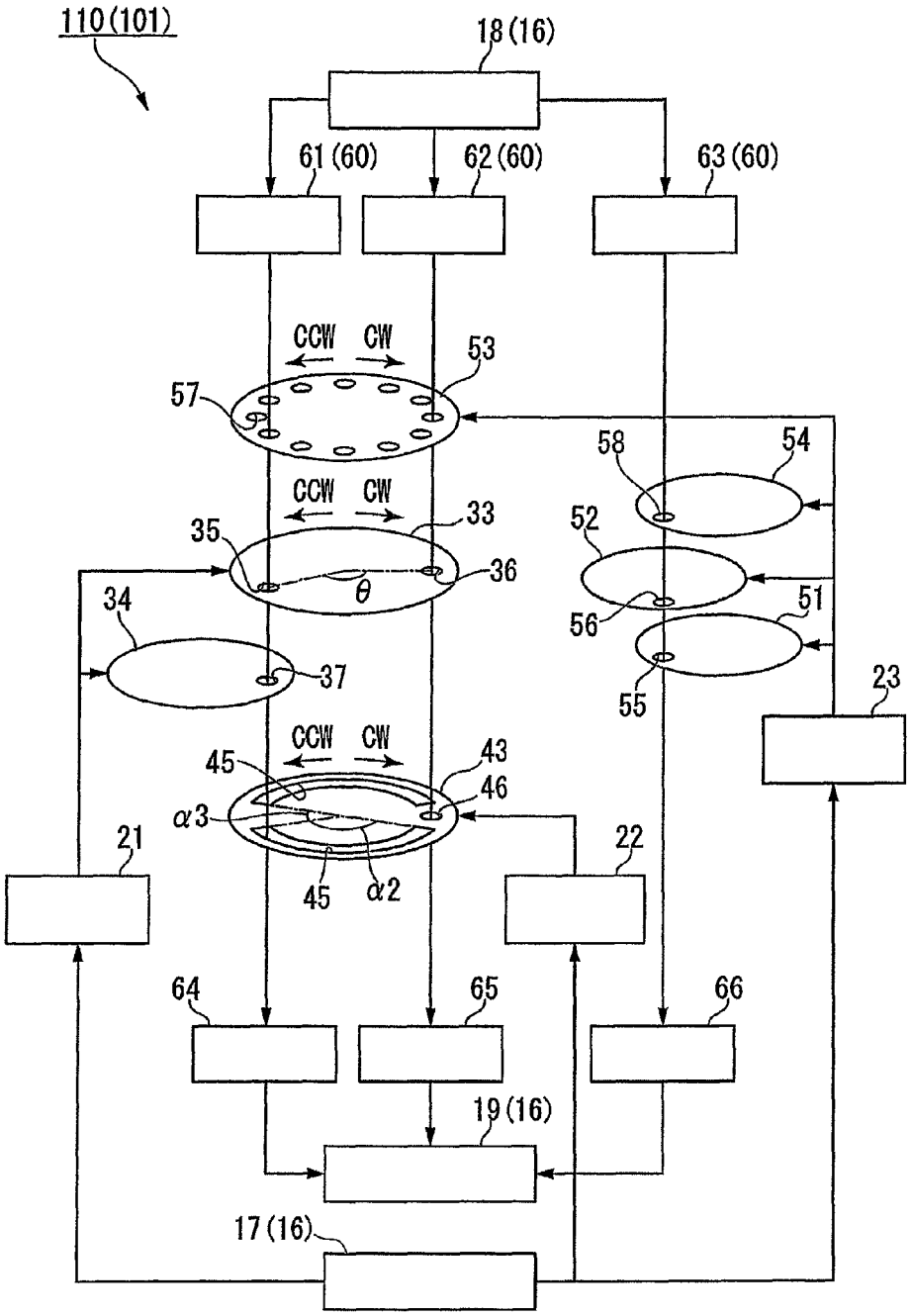
FIG. 17 is a block diagram of the movement according to a second embodiment.

FIG. 17 is a block diagram of the movement according to the second embodiment.

The electronic timepiece 1 according to the first embodiment illustrated in FIGS. 2 and 14 is an analog timepiece of multi-Hz drive in which the second hand 14 is driven multiple times per second. In contrast, an electronic timepiece 101 according to the second embodiment illustrated in FIG. 17 is an analog timepiece of 1 Hz drive in which the second hand 14 is driven once per second. In addition, according to the first embodiment illustrated in FIGS. 2 and 14, the movement 10 includes the second detection wheel 44. In contrast, the second embodiment illustrated in FIG. 17 is different from the first embodiment in that a movement 110 does not include the second detection wheel. The same reference numerals will be given to configurations which are the same as those according to the first embodiment illustrated in FIGS. 1 to 16, and detailed description thereof will be omitted.

Electronic Timepiece

The electronic timepiece 101 according to the present embodiment is an analog timepiece of 1 Hz drive. In other words, the analog timepiece employs a driving method in which a second hand is operated one second by receiving one step drive pulse output from a stepping motor.

Movement

The second wheel & pinion 43 is configured to be rotated once if the second stepping motor 22 is rotated 60 steps, and corresponds to 1 Hz drive. The rotation angle of the second wheel & pinion 43 which corresponds to one step of the second stepping motor 22 is set to 6°. In this manner, the second second wheel transmittable portion 46 located at the second detection position can completely withdraw from the second detection position if the second stepping motor 22 is rotated one step.

Hand Position Detection Operation

The hand position detection operation according to the present embodiment will be described. In the following description, only the second transmitted state searching Step S30 illustrated in FIG. 13 will be described. The minute transmitted state searching Step S10 and the second transmitted state searching transfer Step S20 are the same as those according to the first embodiment, and thus, description thereof will be omitted.

The second transmitted state searching Step S30 includes Step S31 and Step S32 which are similar to those according to the first embodiment illustrated in FIG. 13.

Figure 18:
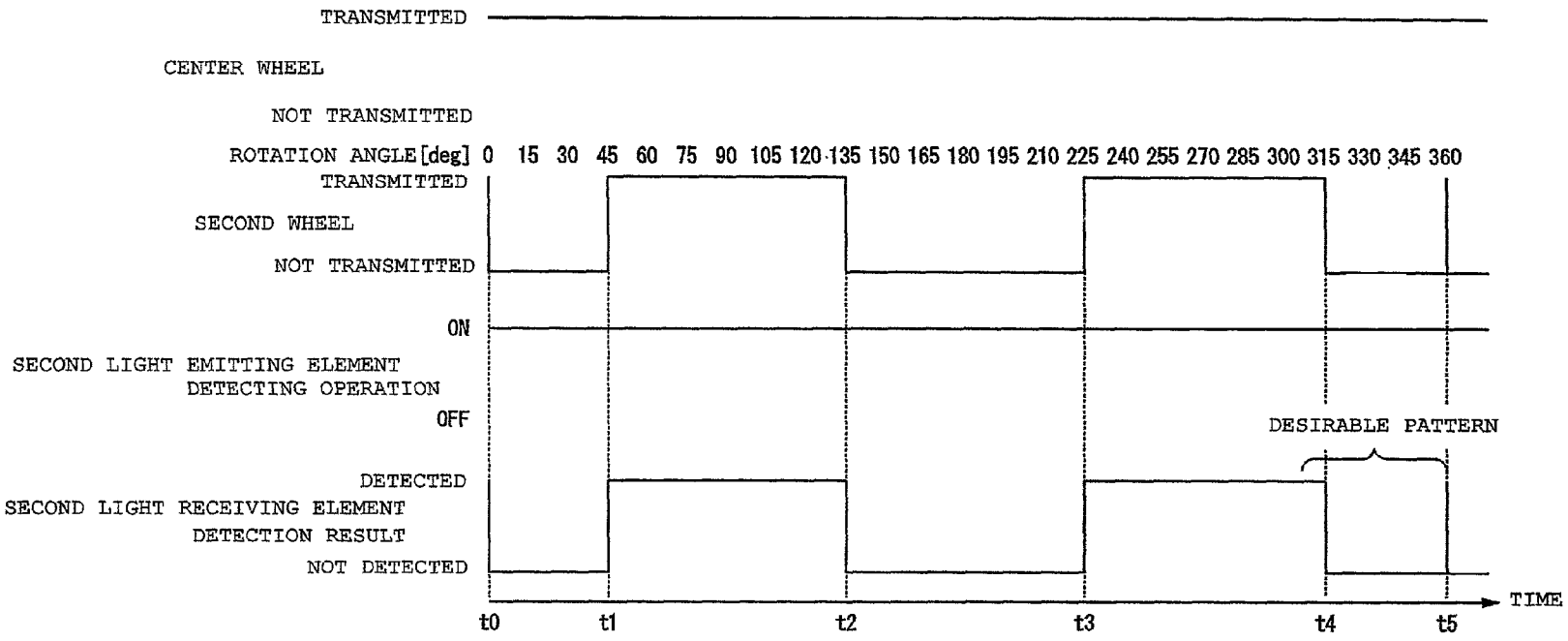
FIG. 18 is a timing chart illustrating a second transmitted state searching step according to the second embodiment.

FIG. 18 is a timing chart illustrating the second transmitted state searching step according to the second embodiment. A transmitted state in the center wheel & pinion and the second wheel & pinion in FIG. 18 represents a state where each transmittable portion belonging to the center wheel & pinion and the second wheel & pinion is located at the second detection position. In addition, a non-transmitted state represents a state where each transmittable portion belonging to the center wheel & pinion and the second wheel & pinion is located at a position other than the second detection position.

In the second transmitted state searching Step S30, the rotation position of the center wheel & pinion 33 is completely detected. Therefore, as illustrated in FIG. 17, the second center wheel transmittable portion 36 of the center wheel & pinion 33 is located at the second detection position. Accordingly, as illustrated in FIG. 18, the center wheel & pinion 33 is always in a transmitted state.

In the second transmitted state searching Step S30, the control unit 16 detects a second desirable pattern (Step S31). In Step S31, the control unit 16 determines whether or not a signal detected in the second light receiving element 65 shows the second desirable pattern.

In a case where it is determined that the second desirable pattern is not detected in Step S31 (S31: No), the rotation control unit 17 causes the second stepping motor 22 to perform one step rotation driving, and rotates the second wheel & pinion 43 in the direction CW as much as the rotation angle (6° in the present embodiment) corresponding to one step of the second stepping motor 22 (Step S32). Subsequently, the second desirable pattern is detected again (Step S31).

A signal detected by the second light receiving element 65 in the second transmitted state searching Step S30 according to the present embodiment will be described. As illustrated in FIGS. 17 and 18, if Step S31 and Step S32 are repeatedly performed, the second wheel & pinion 43 is rotated. A pair of the first second wheel transmittable portion 45 and the second second wheel transmittable portion 46 of the second wheel & pinion 43 respectively pass through the second detection position once, whenever the second wheel & pinion 43 is rotated once. The second wheel & pinion 43 has the first second wheel transmittable portion 45 having a long hole. Accordingly, the first second wheel transmittable portion 45 is in a continuously transmitted state over a period while the first second wheel transmittable portion 45 is located at the second detection position (refer to a period from time t1 to time t2 and a period from time t3 to time t4 in FIG. 18).

The center wheel & pinion 33 and the hour wheel 53 are always in a transmitted state in the second transmitted state searching Step S30. Therefore, when the second wheel & pinion 43 is brought into a transmitted state, the second light receiving element 65 detects the light emitted from the second light emitting element 62.

If one first second wheel transmittable portion 45 completely passes through the second detection position, the second wheel & pinion 43 is rotated as much as 90° until the second light receiving element 65 starts to detect the light transmitted through the other first second wheel transmittable portion 45 (for example, a period from time t2 to time t3 in FIG. 18).

Here, a case will be described where the second second wheel transmittable portion 46 is present between one first second wheel transmittable portion 45 and the other first second wheel transmittable portion 45. In this case, after the second light receiving element 65 finally detects the light transmitted through one first second wheel transmittable portion 45, Step S31 and Step S32 are repeatedly performed. In this manner, if the second wheel & pinion 43 is rotated as much as 45°, the second second wheel transmittable portion 46 is brought into a state of being located at the second detection position. In this case, the second light receiving element 65 detects the light transmitted through the second second wheel transmittable portion 46 (time t5 in FIG. 18). That is, in the example illustrated in FIG. 18, the second light receiving element 65 detects the light when the rotation angle of the second wheel & pinion 43 is 312°. Thereafter, the second light receiving element 65 does not detect the light, whenever the second wheel & pinion 43 is rotated as much as 6° over a period while the rotation angle of the second wheel & pinion 43 is changed from 318° to 354°.

In order to detect the second second wheel transmittable portion 46, the control unit 16 sets a light transmission pattern (second desirable pattern) detected in the second light receiving element 65 to be a pattern showing "detected-detected-not detected-not detected-not detected-not detected-not detected-not detected-not detected-detected", whenever the second wheel & pinion 43 is rotated as much as 6°. In this manner, when the second light receiving element 65 detects the second desirable pattern, after one first second wheel transmittable portion 45 passes through the second detection position, the control unit 16 determines that the second second wheel transmittable portion 46 is in a state of being located at the second detection position.

As described above, in a case where it is determined that the second desirable pattern is detected in Step S31 (S31: Yes), at that time, the second second wheel transmittable portion 46 is located at the second detection position. Accordingly, detecting the rotation position of the second wheel & pinion 43 is completed. Subsequently, the second transmitted state searching Step S30 is completed, and the hand position detection operation is completed.

As described in detail, according to the present embodiment, the electronic timepiece 101 is an analog timepiece of 1 Hz drive, and the rotation angle of the second wheel & pinion 43 which corresponds to one step of the second stepping motor 22 is set to 6°. Therefore, the second second wheel transmittable portion 46 located at the second detection position can completely withdraw from the second detection position if the second stepping motor 22 is rotated one step. As a result, without a need to include the second detection wheel 44 as in the movement 10 according to the first embodiment, one step of the second stepping motor 22 enables the second light receiving element 65 to be transferred between a state where the light emitted from the second light emitting element 62 can be detected and a state where the light cannot be detected. Therefore, it is possible to reliably detect the rotation position of the second wheel & pinion 43 in response to the position detection of the second hand 14.

Then, the light emitted from the second light emitting element 62 and transmitted through the second center wheel transmittable portion 36 and the second second wheel transmittable portion 46 is detected by the second light receiving element 65. In this manner, for example, even in a case where multiple first second wheel transmittable portions 45 are disposed at equal intervals, it is possible to detect the rotation position of the second wheel & pinion 43. In this case, while the second wheel & pinion 43 is rotated, the first second wheel transmittable portion 45 and the second second wheel transmittable portion 46 are caused to pass through the second detection position. A transmission pattern of the light which corresponds to a shape, a position, or the number of the first second wheel transmittable portions 45 and the second second wheel transmittable portions 46 is detected by the second light receiving element 65. In this manner, the second second wheel transmittable portion 46 of the second wheel & pinion 43 is identified in a state where the second second wheel transmittable portion 46 is distinguished from the first second wheel transmittable portion 45. Therefore, it is possible to detect the rotation position of the second wheel & pinion 43.

According to the present embodiment, in the second transmitted state searching Step S30, the rotation position of the second wheel & pinion 43 is detected by using the second light emitting element 62 and the second light receiving element 65, but the present embodiment is not limited thereto. The rotation position of the second wheel & pinion 43 may be detected by using the first light emitting element 61 and the first light receiving element 64 and identifying the second second wheel transmittable portion 46 which passes through the first detection position. In this manner, it is possible to omit the installation of the second light emitting element 62 and the second light receiving element 65, and thus, it is possible to reduce the number of components.

The present invention is not limited to the embodiments described above with reference to the drawings, and it is conceivable to adopt various modification examples within the technical scope of the invention. For example, in the above-described respective embodiments, each transmittable portion disposed in each gear body is disposed by forming a through-hole in the gear body, but a configuration is not limited thereto. For example, each transmittable portion may be disposed in such way that each gear body is formed of an optically transparent material and a region other than each transmittable portion is coated with a coating material having a light blocking effect.

In addition, in the above-described respective embodiments, the light emitting element 60 includes the first light emitting element 61, the second light emitting element 62, and the third light emitting element 63, but a configuration is not limited thereto. For example, the light emitting element may adopt a configuration in which light is emitted toward the respective light receiving elements 64, 65, and 66 after a light guide body guides the light to a position corresponding to the respective light receiving elements 64, 65, and 66 from one light source such as an LED.

In addition, in the above-described respective embodiments, the central angle θ between the first center wheel transmittable portion 35 and the second center wheel transmittable portion 36 of the center wheel & pinion 33 is set to 120°, but a configuration is not limited thereto. The central angle θ between the first center wheel transmittable portion 35 and the second center wheel transmittable portion 36 may be appropriately set within a range in which the central angle is larger than 0° and smaller than 180°.

In addition, in the above-described respective embodiments, except for the first second wheel transmittable portion 45, each transmittable portion is a circular through-hole. However, without being limited thereto, each transmittable portion may be a square hole, for example.

In addition, in the above-described respective embodiments, a pair of the first second wheel transmittable portions 45 having a long hole are disposed, but a configuration is not limited thereto. One first second wheel transmittable portion may be disposed, and three or more first second wheel transmittable portions may be disposed. Furthermore, for example, the first second wheel transmittable portion may be a circular through-hole. In addition, an end portion of the first second wheel transmittable portion may have arcuate shape instead of a rectangular shape. In this case, the end portion has a shape corresponding to an emission shape of the light emitted from the light emitting element. Therefore, it is also possible to reliably detect whether or not the light is received in the end portion having a long hole.

In addition, in the above-described respective embodiments, a gear ratio of the center wheel & pinion 33 with respect to the minute detection wheel 34 is set to 1/30. However, without being limited thereto, a reduction ratio of the minute detection wheel with respect to the center wheel & pinion may be set to 1/integer.

In addition, in the above-described respective embodiments, a gear ratio of the second wheel & pinion 43 with respect to the second detection wheel 44 is set to 1/24. However, without being limited thereto, a reduction ratio of the second detection wheel with respect to the second wheel & pinion may be set to 1/integer.

As described above, an example has been described in which the power source is configured to include the solar panel and the secondary battery. However, the power source may be configured to include a primary battery.

Alternatively, within the scope not departing from the gist of the invention, configuration elements in the above-described embodiments can be appropriately replaced with known configuration elements.

What is claimed is:

1. A movement comprising:

a first gear that is rotated by power of a first drive source so as to drive a first indicating hand;

a second gear that is arranged coaxially with a center axle of the first gear, and that is rotated by power of a second drive source so as to drive a second indicating hand;

a light emitting element that is arranged on one side in an axial direction of the center axle of the first gear, with respect to the first gear and the second gear; and a first light receiving element that is arranged on the other side in the axial direction across the first gear and the second gear, and that detects light emitted from the light emitting element, wherein the first gear has a first transmittable portion through which the light emitted from the light emitting element is transmittable, and a second transmittable portion which is disposed on a rotation trajectory of the first transmittable portion and through which the light emitted from the light emitting element is transmittable, wherein the second gear has a third transmittable portion which is disposed on the rotation trajectory of the first transmittable portion and the second transmittable portion when viewed in the axial direction, and through which the light emitted from the light emitting element is transmittable, and wherein the first transmittable portion, the second transmittable portion and the third transmittable portion are configured and arranged to enable detection, in one detecting sequence by rotationally driving the first gear in only one direction, of a position of the first gear and the second gear.

2. The movement according to claim 1, wherein the third transmittable portion comprises a pair of third transmittable portions each comprising a long hole along a circumferential direction of the second gear, and a dimension along the circumferential direction of each third transmittable portion is equal to or greater than the separated distance along the circumferential direction between end portions of the pair of third transmittable portions.

3. The movement according to claim 1, wherein the second gear has a fourth transmittable portion which is disposed on the rotation trajectory of the third transmittable portion, and through which the light emitted from the light emitting element is transmittable.

4. The movement according to claim 1, further comprising:

a control unit that controls driving of the first drive source and the second drive source, and that detects the light received by the first light receiving element, wherein a central angle formed between the first transmittable portion and the second transmittable portion in the first year is set to θ, wherein the control unit is configured to perform:

a transmitted state determination step of determining whether or not the first light receiving element receives the light emitted from the light emitting element, a rotation angle determination step of determining whether or not a rotation angle of the first gear is equal to or larger than 360°−θ, in a case where the first light receiving element does not receive the light emitted from the light emitting element in the transmitted state determination step, a first drive step of performing the transmitted state determination step again by driving the first drive source and rotating the first gear, in a case where the control unit determines that the rotation angle of the first gear is not equal to or larger than 360°−θ, in the rotation angle determination step, and a second drive step of performing the transmitted state determination step again by driving the second drive source and rotating the second gear as much as a predetermined angle, in a case where the control unit determines that the rotation angle of the first gear is equal to or larger than 360°−θ, in the rotation angle determination step.

5. An electronic timepiece comprising:

the movement according to claim 1; and a power source that supplies power to the first drive source and the second drive source.

6. The electronic timepiece according to claim 5, further comprising:

a solar panel that supplies power to the first drive source and the second drive source.

7. The movement according to claim 1; wherein a central angle between the first transmittable portion and the second transmittable portion is θ, and the first gear is rotationally driven not more than 360°−θ in performing one detecting sequence.

8. The movement according to claim 1, wherein the first gear is a minute wheel.

9. A movement comprising:

a first gear that is rotated by power of a first drive source so as to drive a first indicating hand;

a second gear that is arranged coaxially with a center axle of the first gear, and that is rotated by power of a second drive source so as to drive a second indicating hand;

a light emitting element that is arranged on one side in an axial direction of the center axle of the first gear, with respect to the first gear and the second gear;

a first light receiving element that is arranged on the other side in the axial direction across the first gear and the second gear, and that detects light emitted from the light emitting element;

a second light receiving element that is disposed on the other side in the axial direction across the first gear and the second gear; and a first position detecting gear that is arranged between the light emitting element and the second light receiving element in the axial direction, and that is rotated by the power of the second drive source, wherein the first gear has a first transmittable portion through which the light emitted from the light emitting element is transmittable, and a second transmittable portion which is disposed on a rotation trajectory of the first transmittable portion and through which the light emitted from the light emitting element is transmittable, wherein the second gear has a third transmittable portion which is disposed on the rotation trajectory of the first transmittable portion and the second transmittable portion when viewed in the axial direction, and through which the light emitted from the light emitting element is transmittable, wherein the first position detecting gear has a fifth transmittable portion through which the light emitted from the light emitting element is transmittable, wherein the second light receiving element is disposed so that the light emitted from the light emitting element and transmitted through the second transmittable portion can be detected, in a predetermined state where the first gear can transmit the light emitted from the light emitting element to the first light receiving element in the first transmittable portion, and wherein when viewed in the axial direction, the fifth transmittable portion is disposed so as to be located at a position corresponding to the fourth transmittable portion, when the fourth transmittable portion is located at a position corresponding to the second transmittable portion of the first gear in the predetermined state.

10. A movement comprising:

a first gear that is rotated by power of a first drive source so as to drive a first indicating hand;

a second gear that is arranged coaxially with a center axle of the first gear, and that is rotated by power of a second drive source so as to drive a second indicating hand;

a light emitting element that is arranged on one side in an axial direction of the center axle of the first gear, with respect to the first gear and the second gear;

a first light receiving element that is arranged on the other side in the axial direction across the first gear and the second gear, and that detects light emitted from the light emitting element; and a second position detecting gear that is arranged between the light emitting element and the first light receiving element in the axial direction, and that is rotated by the power of the first drive source, wherein the first gear has a first transmittable portion through which the light emitted from the light emitting element is transmittable, and a second transmittable portion which is disposed on a rotation trajectory of the first transmittable portion and through which the light emitted from the light emitting element is transmittable, wherein the second gear has a third transmittable portion which is disposed on the rotation trajectory of the first transmittable portion and the second transmittable portion when viewed in the axial direction, and through which the light emitted from the light emitting element is transmittable, wherein the second position detecting gear has a sixth transmittable portion through which the light emitted from the light emitting element is transmittable, wherein when viewed in the axial direction, the sixth transmittable portion is disposed so as to be located at a position corresponding to the first transmittable portion, in a state where the first gear can transmit the light emitted from the light emitting element to the first light receiving element in the first transmittable portion, and wherein when viewed in the axial direction, the sixth transmittable portion is disposed so as to be located at a position corresponding to the second transmittable portion, in a state where the first gear can transmit the light emitted from the light emitting element to the first light receiving element in the second transmittable portion.

11. A movement comprising:

a first gear that is rotated by power of a first drive source so as to drive a first indicating hand;

a second gear that is arranged coaxially with a center axle of the first gear, and that is rotated by power of a second drive source so as to drive a second indicating hand;

a light emitting element that is arranged on one side in an axial direction of the center axle of the first gear, with respect to the first gear and the second gear;

a first light receiving element that is arranged on the other side in the axial direction across the first gear and the second gear, and that detects light emitted from the light emitting element; and a second position detecting gear that is arranged between the light emitting element and the first light receiving element in the axial direction, and that is rotated by the power of the first drive source, wherein the first gear has a first transmittable portion through which the light emitted from the light emitting element is transmittable, and a second transmittable portion which is disposed on a rotation trajectory of the first transmittable portion and through which the light emitted from the light emitting element is transmittable, wherein the second gear has a third transmittable portion which is disposed on the rotation trajectory of the first transmittable portion and the second transmittable portion when viewed in the axial direction, and through which the light emitted from the light emitting element is transmittable, wherein the second position detecting gear has a sixth transmittable portion through which the light emitted from the light emitting element is transmittable, wherein when viewed in the axial direction, the sixth transmittable portion is disposed so as to be located at a position corresponding to the first transmittable portion, in a state where the first gear can transmit the light emitted from the light emitting element to the first light receiving element in the first transmittable portion, and wherein when viewed in the axial direction, the sixth transmittable portion is disposed so as to be located at a position corresponding to the second transmittable portion, in a state where the first gear can transmit the light emitted from the light emitting element to the first light receiving element in the second transmittable portion.

* * * * *